US009781991B1

(12) United States Patent
Bouix et al.

(10) Patent No.: US 9,781,991 B1
(45) Date of Patent: Oct. 10, 2017

(54) HEATING APPLICATOR SYSTEM WITH REUSABLE COMPONENTS

(71) Applicant: ELC Management LLC, Melville, NY (US)

(72) Inventors: Herve F. Bouix, New York, NY (US); Christophe Jacob, Roussillon (FR)

(73) Assignee: ELC MANAGEMENT LLC, Melville, NY (US)

( * ) Notice: Subject to any disclaimer, the term of this patent is extended or adjusted under 35 U.S.C. 154(b) by 106 days.

(21) Appl. No.: 15/071,811

(22) Filed: Mar. 16, 2016

(51) Int. Cl.

| | |
|---|---|
| ***A47L 13/32*** | (2006.01) |
| ***A45D 40/18*** | (2006.01) |
| ***A45D 40/26*** | (2006.01) |
| ***H05B 3/00*** | (2006.01) |
| *A45D 40/00* | (2006.01) |

(52) U.S. Cl.
CPC ..... *A45D 40/18* (2013.01); *A45D 40/267* (2013.01); *H05B 3/0014* (2013.01); *A45D 2040/0006* (2013.01); *A45D 2200/155* (2013.01); *A45D 2200/157* (2013.01)

(58) Field of Classification Search
CPC ..... A45D 2200/155; A45D 2200/157
USPC ..... 401/1–2
See application file for complete search history.

(56) References Cited

U.S. PATENT DOCUMENTS

| | | | | |
|---|---|---|---|---|
| 5,620,270 | A | 4/1997 | Gueret | |
| 7,448,814 | B2 | 11/2008 | Bouix et al. | |
| 7,753,609 | B2 | 7/2010 | Houix | |
| 8,142,090 | B2 | 3/2012 | Kamada et al. | |
| 8,262,302 | B1 | 9/2012 | Bouix et al. | |
| 8,308,383 | B2 | 11/2012 | Bouix et al. | |
| 8,585,307 | B2 | 11/2013 | Bouix et al. | |
| 8,950,962 | B2 | 2/2015 | Bouix et al. | |
| 8,998,517 | B2 * | 4/2015 | Giancana | A45D 40/265 401/1 |
| 2003/0105425 | A1 | 6/2003 | Pauchet | |
| 2004/0247367 | A1 | 12/2004 | Fontaine | |
| 2007/0273331 | A1 | 11/2007 | Cross et al. | |
| 2007/0286665 | A1 | 12/2007 | Bouix et al. | |

(Continued)

FOREIGN PATENT DOCUMENTS

| | | |
|---|---|---|
| JP | S59-101911 | 7/1984 |
| JP | S63-147116 | 9/1988 |

*Primary Examiner* — Jennifer C Chiang
(74) *Attorney, Agent, or Firm* — Peter Giancana

(57) ABSTRACT

A heating applicator system that heats personal care products without concerns of dry-out as a result of repeated exposure to heat comprising a disposable container subassembly and a reusable handle subassembly. The container subassembly comprises a lower printed circuit board that has heating elements disposed thereon. The reusable handle subassembly houses an upper printed circuit board that has electronic control elements. When the handle subassembly is attached to the container subassembly, the two circuit boards form an electric connection and create an electric heating circuit. Subsequently, the handle subassembly is able to detach from the container while the applicator head remains attached to the handle subassembly. After each use, the applicator head is replaced in the container. When the product is used up, the applicator head and the container can be detached from the handle subassembly. The handle subassembly can be reused, while the container and applicator head are discarded.

15 Claims, 22 Drawing Sheets

(56) References Cited

U.S. PATENT DOCUMENTS

| | | | |
|---|---|---|---|
| 2007/0286666 | A1 | 12/2007 | Bouix et al. |
| 2007/0286831 | A1 | 12/2007 | Kamada et al. |
| 2008/0216857 | A1 | 9/2008 | Tranchant et al. |
| 2008/0236608 | A1 | 10/2008 | Tranchant et al. |
| 2009/0071501 | A1 | 3/2009 | Gueret |
| 2010/0024836 | A1 | 2/2010 | Degennes |
| 2010/0054841 | A1 | 3/2010 | Cho |
| 2011/0123248 | A1 | 5/2011 | Kim |
| 2011/0200381 | A1 | 8/2011 | Bylsma et al. |

* cited by examiner

HEATING APPLICATOR SYSTEM WITH REUSABLE COMPONENTS

FIELD OF THE INVENTION

The present invention is in the field of cosmetic and personal care products. In particular, the present invention concerns a handheld applicator system with reusable components for heating a personal care product.

BACKGROUND

Heating mascara applicators have only recently begun to appear on the market. In U.S. Pat. No. 8,585,307, U.S. Pat. No. 8,950,962 and U.S. Pat. No. 8,262,302, we addressed some of the problems created by using a heated applicator with a mascara product. In order to address the problem of dry-out in a full size salable mascara container, we developed a reusable heating applicator for use with a set of disposable unit dose mascara containers or disposable mascara containers that hold only enough product for a few applications. As described in those patents, an elongated stem that supports the heating elements projects five or more centimeters from the reusable handle of the applicator. This is so that the heating elements can be inserted into the applicator head, immediately below the bristle portion of the applicator head. However, this elongated stem is unattractive, and being relatively delicate, is subject to breakage. Thus, there is room for improvement in the heated mascara market.

OBJECTS OF THE INVENTION

A main object of the invention is to provide an applicator system for heating personal care products, wherein the applicator system has reusable components.

Another object is to provide an applicator system for heating personal care products that avoids dry-out of the product.

Another object of the invention is to provide an applicator system for heating personal care products, wherein the reusable handle subassembly does not have an unsightly, elongated stem projecting from the handle, as in U.S. Pat. No. 8,950,962, for example.

SUMMARY

The present invention addresses the need for a heating applicator system that heats personal care products without concerns of dry-out as a result of repeated exposure to heat, while also addressing the concerns noted above. In some embodiments of the invention, an applicator system with reusable components for heating a personal care product comprises a disposable container subassembly and a reusable handle subassembly. The container subassembly comprises a container for holding product and an applicator head that houses a lower printed circuit board that has heating elements disposed thereon. The reusable handle subassembly functions as a handle, and houses a battery and an upper printed circuit board that has electronic control elements. When the handle subassembly is attached to the container subassembly, the two circuit boards form an electric connection. Thereafter, the handle subassembly is able to be detached from the container, such that the applicator head is removed from a container, and becomes associated with the handle subassembly. After use, the handle subassembly is able to be reconnected to the container, such that the applicator head is again disposed in the container. When the product is used up, the handle subassembly can be detached from the applicator head and from the container. The electrical connection between the two circuit boards is broken, and the handle subassembly is restored to its original form. There is no elongated member projecting from the handle subassembly so the possibility of breakage is eliminated, and the appearance of the component is improved.

DEFINITIONS

"Handheld applicator" means an applicator that is intended to be held in one, or at most, two hands, and raised in the air as the applicator is performing one or more main activities. Main activities include using the applicator to transfer product from the reservoir to an application surface. Thus, "handheld" means more than just being able to grasp an object. For example, a "space heater" does not meet this definition of handheld.

Throughout the specification "comprise" means that an element or group of elements is not automatically limited to those elements specifically recited, and may or may not include additional elements.

Throughout the specification, "electrical contact" means that, if a potential difference is provided between electronic elements, then an electric current is able to flow between those elements, whether there is direct physical contact between the elements or whether one or more other conductive elements intervene.

Various features of some of the embodiments will now be described. Certain described features may be used separately or in combination with other described or implied features. Some of the embodiments may use only one or more described features.

DETAILED DESCRIPTION

Figure 1:
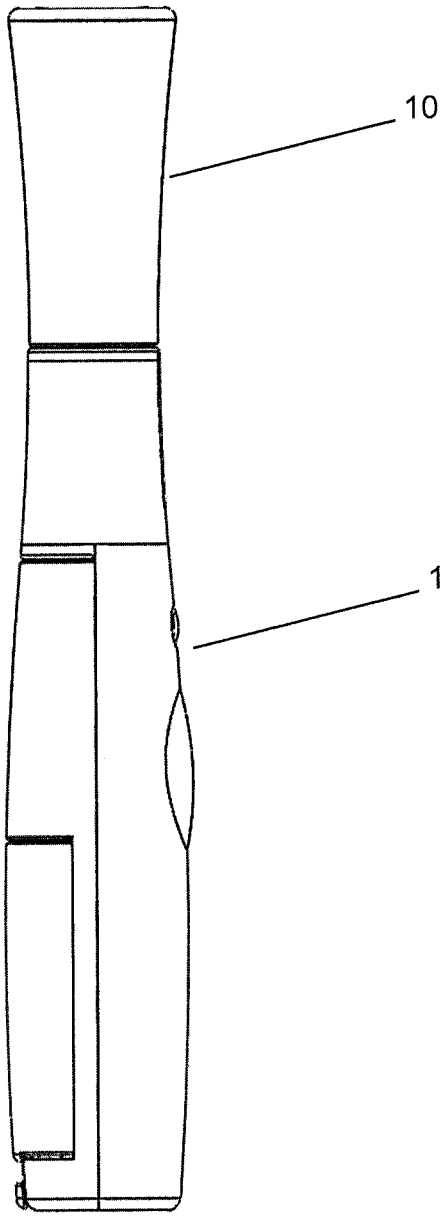
FIG. 1 depicts a heating applicator according to the present invention, comprising a reusable handle subassembly (1) and a disposable container subassembly (10).

A preferred embodiment of a handheld heating applicator system according to the present invention is shown in FIG. 1. It comprises a reusable handle subassembly (1) detachably connected to a container subassembly (10). The handle subassembly is considered reusable in that when the contents of the container subassembly are exhausted, the handle subassembly may be transferred to a fresh container subassembly for continued use. In the description that follows, the invention will be described in relation to a mascara product and applicator.

The Reusable Handle Subassembly

Figure 2:
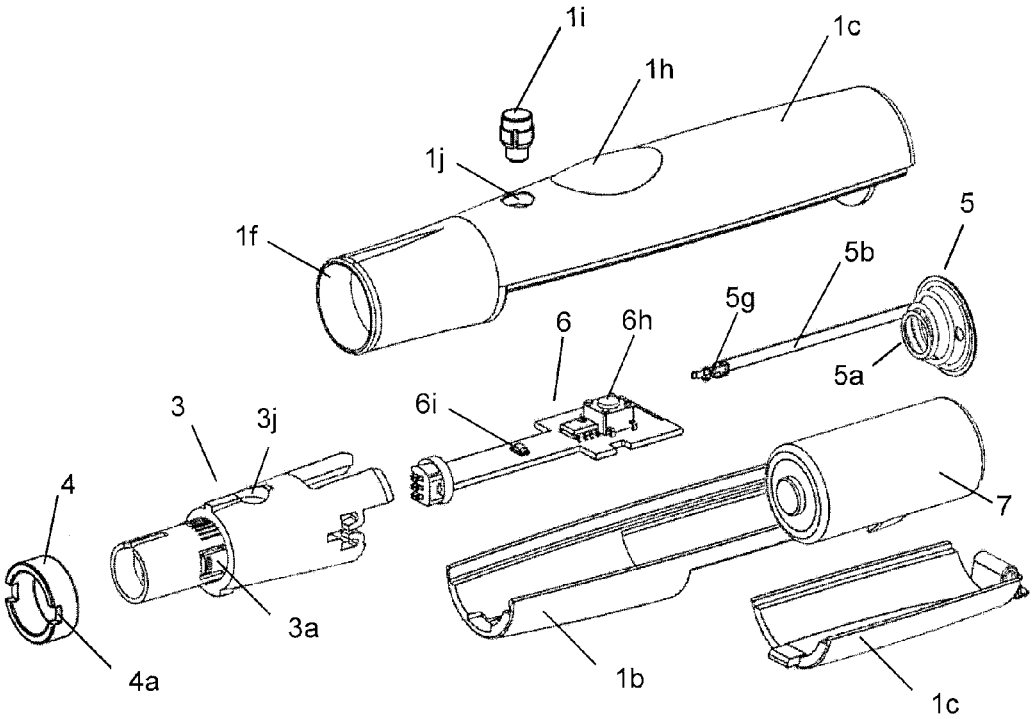
FIG. 2 is an exploded view of one embodiment of a reusable handle subassembly (1).
Figure 3:
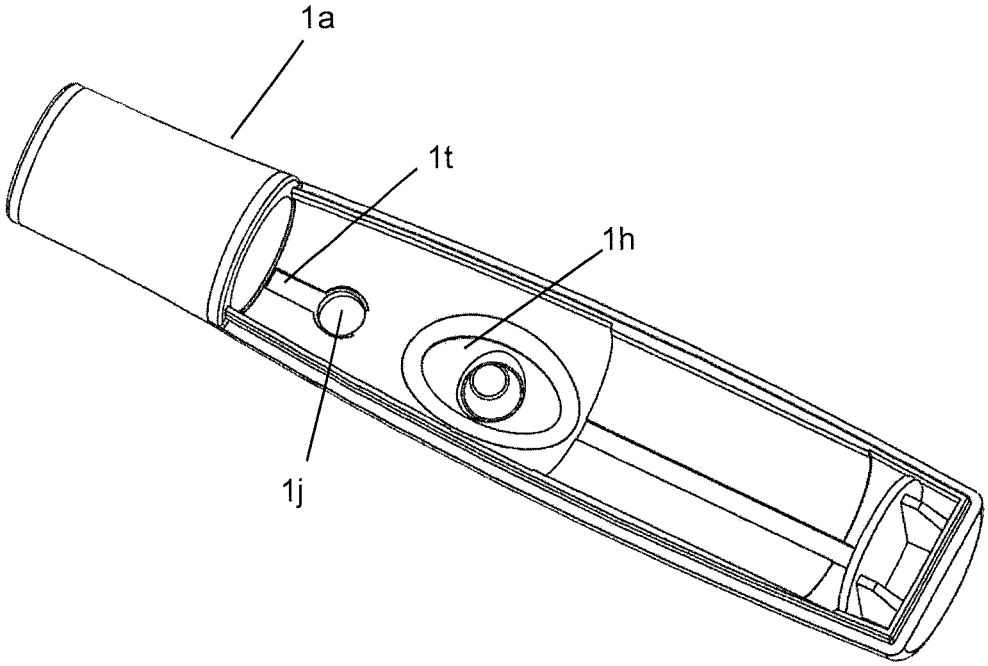
FIG. 3 depicts a first body section (1*a*) of the handle subassembly (1).
Figure 4:
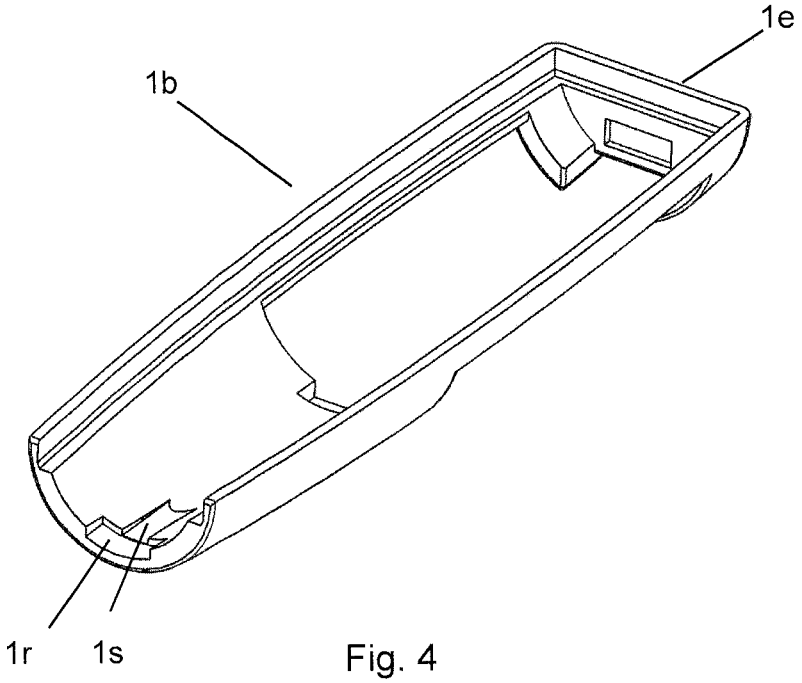
FIG. 4 depicts a second body section (1*b*) of the handle subassembly (1).

An exploded view of a reusable handle subassembly (1) according to the invention is shown in FIG. 2. The handle subassembly comprises first and second body sections (1*a*, 1*b*; shown in more detail in FIGS. 3 and 4) and a door (1*c*) for a battery compartment (1*g*). Together, these three components define a hollow, elongated handle (1*d*) that has a closed proximal end (1*e*) and an opened distal end (1*f*). In the figures, this handle is shown as generally cylindrical, although a cylindrical shape is not required. The handle is large enough to be grasped by a user of personal care products, as is typically done in the field. For example, the handle may be part of a mascara applicator that is from 15 mm to 150 mm in length and from 10 mm to 50 mm in diameter. An on-off control (1*h*) is located on the surface of the handle (1*d*). The control may be capable of interrupting an electric current, or the control may simply operate an electrical switch within the handle (1*d*). For example, in the drawings, a button control (1*h*) is located on the first body section (1*a*). When depressed, the button control interacts with an on-off switch (6*h*) located on the upper printed circuit board (PCB) (6). Other types of on-off controls may be used. A portion of an LED reflector (1*i*) passes through a hole (1*j*) in the first body section (1*a*), and continues through a hole (3*j*) located in the stem (3, see below), directly above an LED (6*i*) located on the upper PCB.

Figure 5:
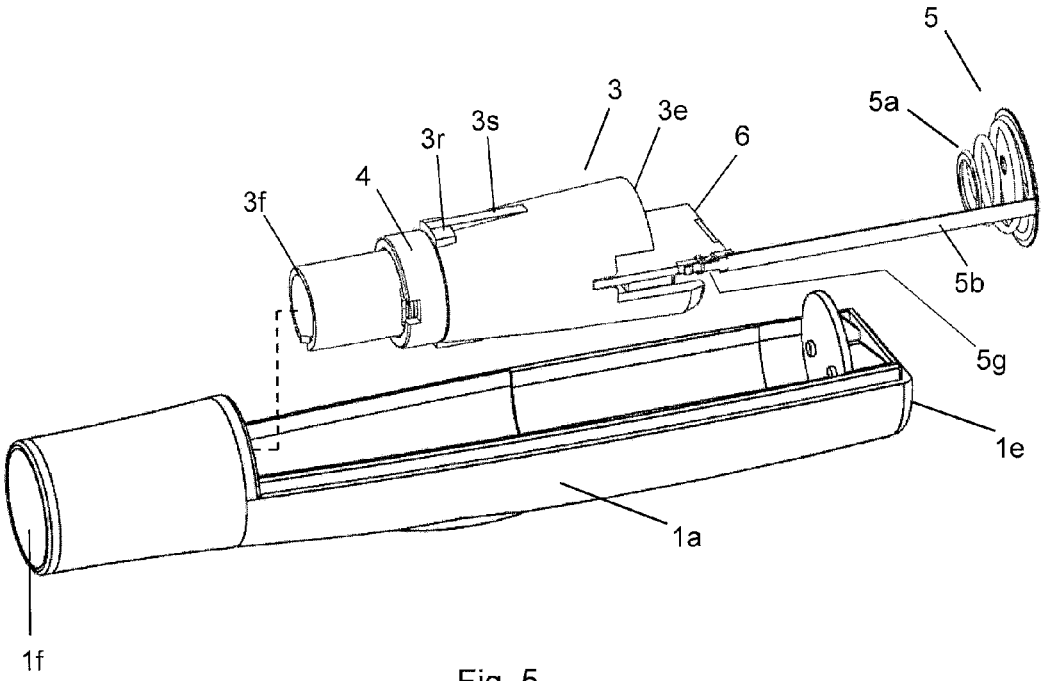
FIG. 5 shows how the stem (3), magnet (4), battery lead (5) and upper printed circuit board (6) fit into the first body section (1*a*) of a reusable handle subassembly (1).
Figure 6:
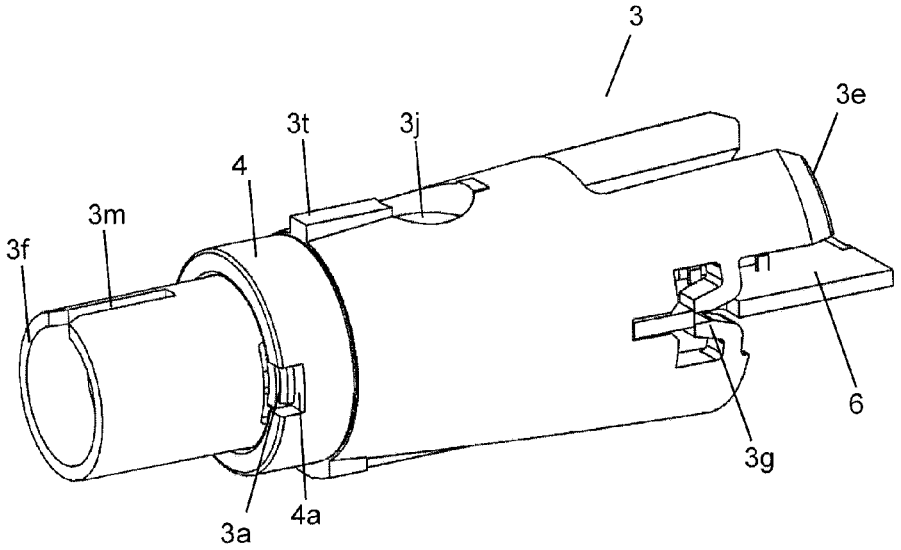
FIG. 6 depicts the stem (3) with the upper printed circuit board (6) locked inside.
Figure 7:
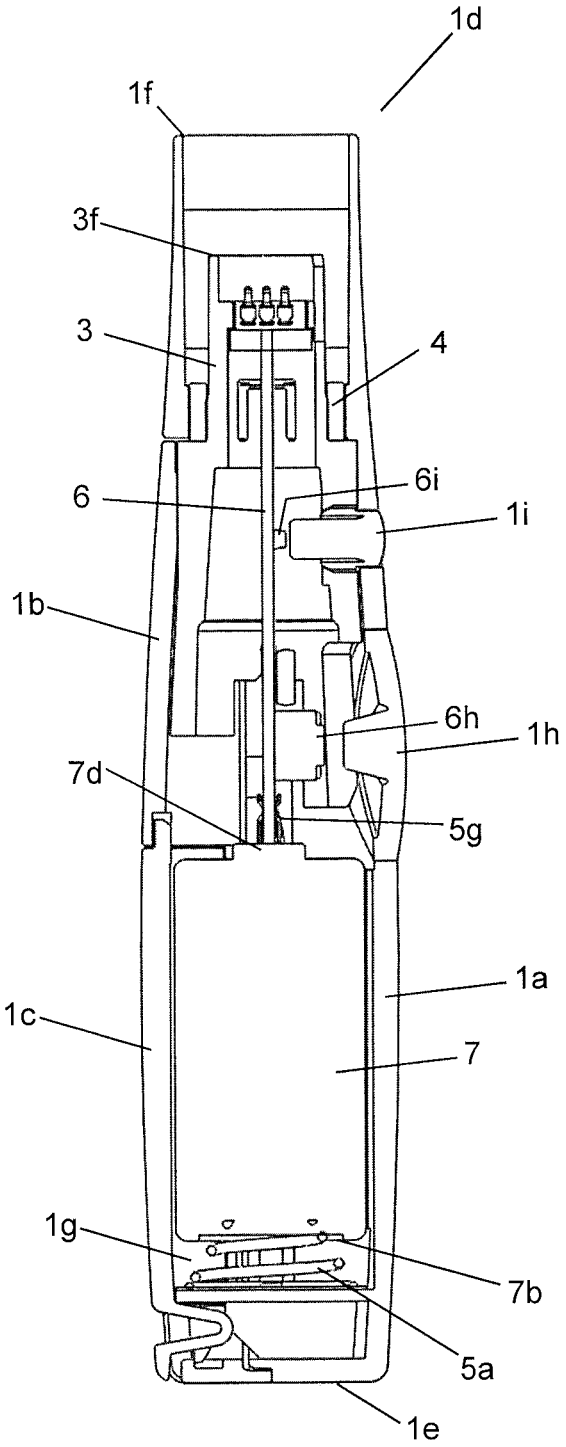
FIG. 7 is a cross section of an elevation view of a reusable handle subassembly (1) according to the present invention.

Referring to FIGS. 5-7, the reusable handle subassembly (1) also comprises stem (3), magnet (4), and battery lead (5). The stem is a hollow, rigid, and roughly cylindrical component that has a proximal end (3*e*) and a distal end (3*f*). The stem is housed inside the elongated handle (1*d*), and it supports and protects a upper PCB (6), which is disposed in the stem. The stem may be equipped with arcuate rib (3*r*) which is received into arcuate slot (1*r*) on the second body section (1*b*), as well as linear ribs (3*s*, 3*t*), which are received into linear slots (1*s*, 1 *t*) located on the second body section and first body section (1*a*), respectively. This arrangement of ribs and slots secures the stem against movement within the handle (1*d*). Other means of achieving the same effect may be readily apparent. The stem supports and protects a upper PCB (6), which extends through the stem. A portion of the stem (3) may be fashioned as a clip (3*g*) that retains the upper PCB (6) in place once it has been inserted into the stem (see FIG. 6). In the handle subassembly, the distal end (3*f*) of the stem (3) resides toward the distal end (1*f*) of the elongated handle (1*d*), but does not extend beyond it.

The battery lead (5) has a coiled portion (5*a*) that is secured near the proximal end (1*e*) of the handle (1*d*). The coiled portion contacts the negative terminal (7*b*) of the battery (7). A straight leg portion (5*b*) extends from the coiled portion along the side of the battery compartment (1*g*) until it makes electrical contact with the upper PCB (6). The end of the straight leg portion may be fashioned as clip (5*g*) which grips electrical contact (6*b*) located on a side of the upper PCB to maintain a stable electrical connection.

The ring magnet (4) is disposed over the distal end (3*f*) of the stem (3). Preferably, the ring magnet cannot slide off of the stem by unintentional means. To this end, the ring magnet may be provided with one or more notches (4*a*) that cooperate with one or more flexible fitments (3*a*) of the stem to retain the ring magnet on the stem. Once the stem, upper PCB (6), battery lead (5) and magnet (4) are reposed inside the first body section (1*a*), then the first body section and second body section (1*b*) may be attached by any suitable means including snap fitments, welding and adhesive. Once assembled, the first and second body sections do not need to be separable. The door (1*c*) provides access to the one or more batteries (7) located in the battery compartment (1*g*). The batteries may be replaced or removed for recharging through this door. A cross sectional view of the handle subassembly (1), as so far described, is shown in FIG. 7.

Figure 8:
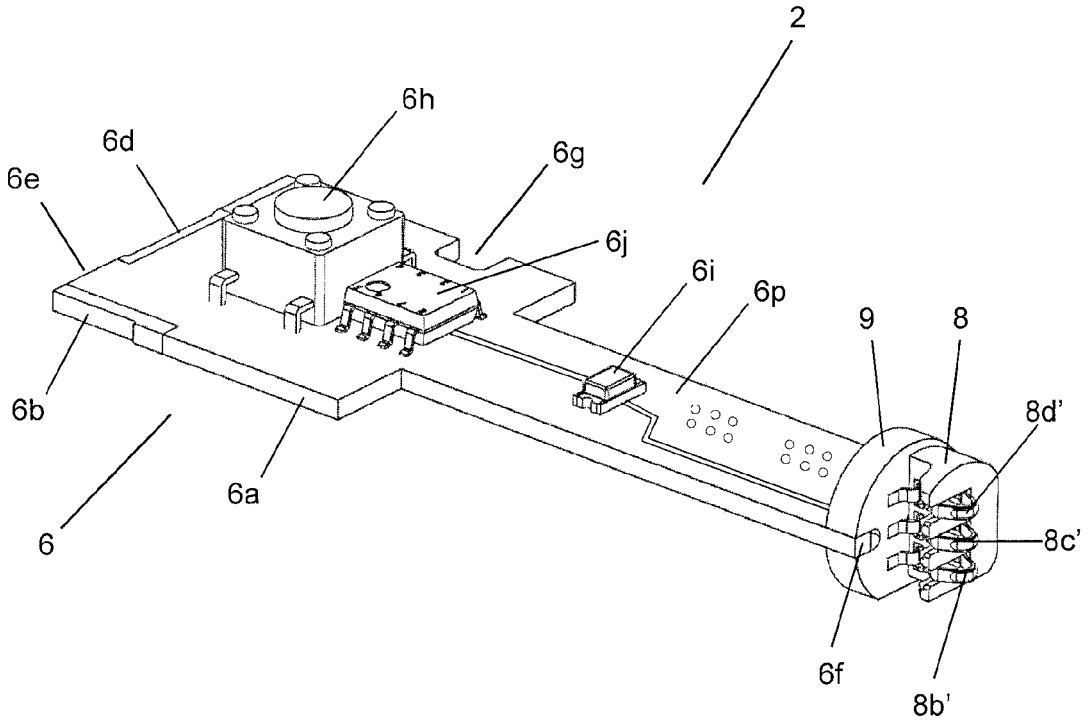
FIG. 8 depicts one embodiment of the upper printed circuit board (6) having a custom three pin connector (8) on its distal end.

The upper PCB (6) is actually part of a larger control board subassembly (2). Referring to FIG. 8, the control board subassembly comprises the upper PCB (6), a custom 3-pin connector (8) and an optional soldering plate (9). The upper PCB is an elongated structure that is housed in the stem (3). A cutout (6*g*) may interact with clip (3*g*) of the stem to retain the upper PCB in place once it has been inserted into the stem. Because the cutout (6*g*) is located on only one side of the upper PCB, there is only one way orientation in which to insert the upper PCB into the stem. The upper PCB itself may have any shape or dimensions that are convenient to manufacture and assemble into the stem (3). The upper PCB comprises a substrate (6*a*) that is non-conductive to electricity under the conditions of normal or expected use. Suitable substrate materials include, but are not limited to, epoxy resin, glass epoxy, Bakelite (a thermosetting phenol formaldehyde resin), and fiberglass. The substrate may be about 0.25 to 5.0 mm thick, preferably 0.5 to 3 mm, more preferably, 0.75 to 1.5 mm thick. Portions of one or both sides of the substrate may be covered with a layer of copper, for example, about 35 μm thick.

Various electrical components are included on one or both sides (6*p*, 6*q*) of the upper PCB (6), whose purpose it is to control the flow of electricity in the completed heated applicator system. As noted above, an on-off control (1*h*) may be located on the surface of the handle (1*d*). The control interacts with an on-off switch (6*h*) located on the upper PCB (6). In the completed applicator system, this on-off switch is effective to alternately open and close an electric heating circuit and, optionally, a control circuit. On example of a useful on-off switching mechanism is FSMJSM Series 6×6 surface mount tactile switch from Tyco Electronics, with an actuator length of 5 mm. Generally, when the heating circuit is closed, current flows to a heat generating portion (16, see below), and this defines the heat generating portion as "on". When this heating circuit is opened, current cannot flow to the heat generating portion, and this defines the heat generating portion as "off". Other types of electronic components located on the upper PCB will typically include resistors and capacitors, thermistors, amplifiers, MOSFET switches, voltage dividers, voltage comparators, power inverters, noise reducing components, light emitting diodes (LEDs), integrated circuits and central processing units (CPUs, 6*j*), etc. One example of a useful CPU is a mixed signal controller from Texas Instruments, reference MSP430G22x0—micro controller Msp430 series G (2 k flash, 128 B RAM), which can be easily programmed for any temperature sequence.

An overhead timer may be included to automatically shut off the heating circuit if the user fails to do so. Also, since a user needs time to apply the product after it has been heated, the circuit may be designed to turn off the heat generating portion some amount of time after the heat generating portion has reached a predetermined temperature. This length of time can be chosen according to need, but may typically be from about 2 to 5 minutes. Furthermore, depending on the level of sophistication employed, the overhead timer may require a reset period, following an automatic shut off, in which the heating circuit cannot be activated (i.e. cannot be "turned on"). The reset time, which may be several seconds, allows the capacitors to discharge. The upper PCB (6) may further support a system for monitoring and maintaining an output voltage of the power source. For example, batteries are rated with a nominal voltage, such 3 volts, but there is some variability from battery to battery, and from use to use of the same battery. An optional system may be included that monitors and adjusts as needed, the battery voltage, to maintain a tighter tolerance of voltage than the battery normally supplies. One benefit of such a system is improved consistency in applicator performance and improved predictability in battery lifetime.

Figure 9:
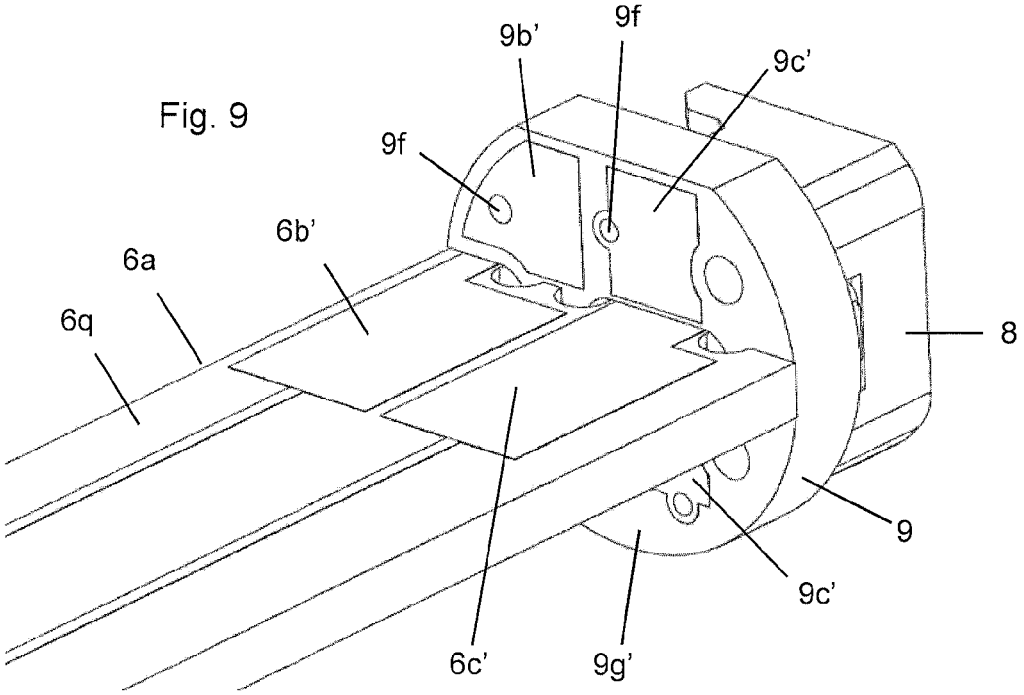
FIG. 9 is a close up of one side of the distal end of the upper printed circuit board (6) of FIG. 8.

In FIG. 7, the upper PCB (6) is able to be connected to a battery (7) when the battery is reposed in the battery compartment (1*g*). In FIG. 8, an electrical contact (6*b*) is located near the proximal end (6*e*) of the upper PCB (6). In the final assembly, electrical power from the negative terminal (7*b*) of the battery (7) enters the upper printed circuit board at (6*b*). From there, the power is conveyed across the upper PCB, eventually to reach the negative soldering contact (6*b*') located on one side of the distal end (6*f*) of the upper PCB (see FIG. 9).

Figure 10:
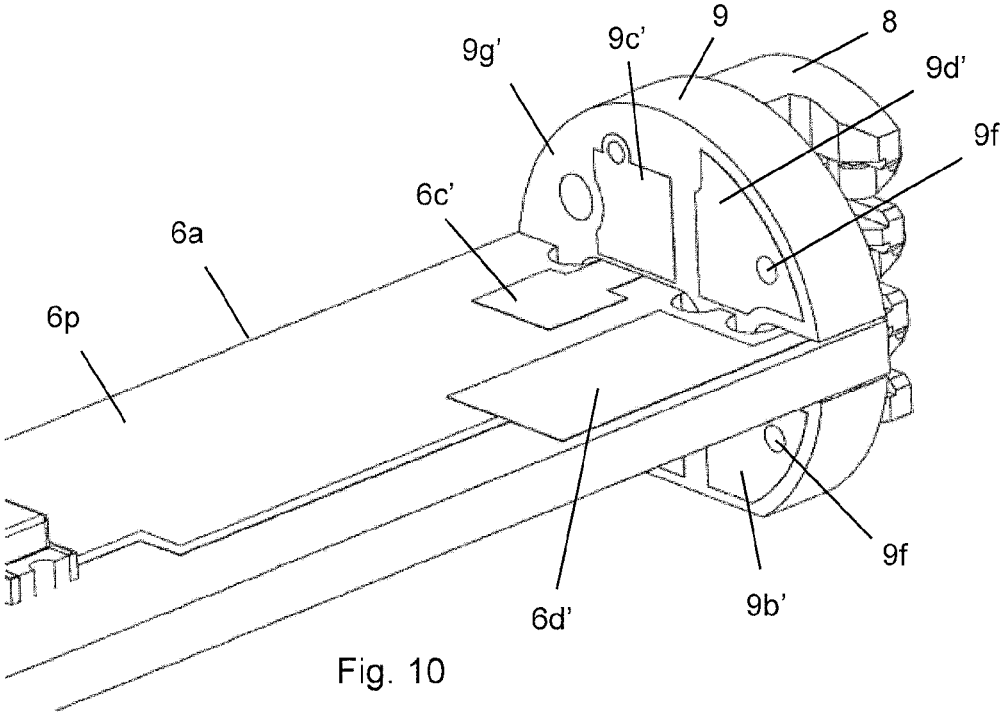
FIG. 10 is a close up of the other side of the distal end of the upper printed circuit board (6) of FIG. 8.

Referring to FIG. 10, a positive soldering contact (6*d*') is located at the distal end of the upper PCB (6), but on the side opposite the negative soldering contact (6*b*'). This positive soldering contact is electrically connected to contact (6*d*), which is located at the proximal edge of the upper PCB (see FIG. 8) where it can be contacted directly by the positive terminal (7*d*) of the battery (7).

Also located near the distal end (6*f*) of the upper PCB (6) are one or more contacts (6*c*'), which may be located on either or both sides the upper PCB, but which are electrically connected to each other through the upper PCB, and electrically connected to circuit control elements located on the upper PCB.

Figure 11:
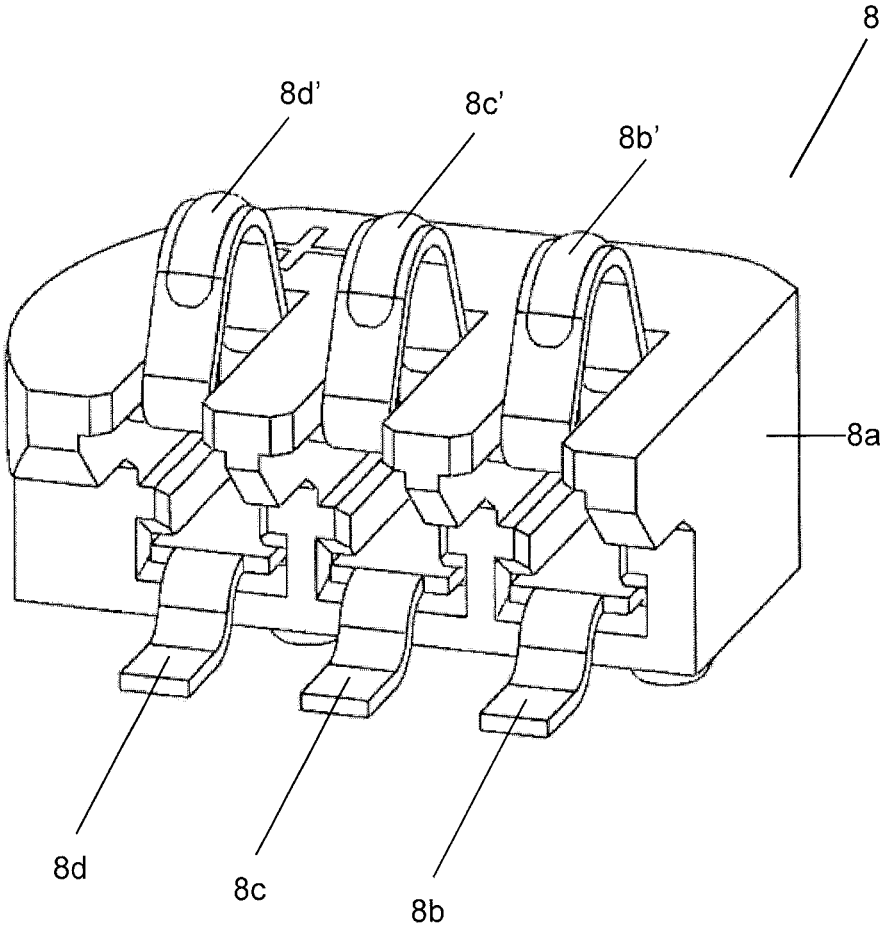
FIG. 11 is a perspective view of a custom three pin connector (8).
Figure 12:
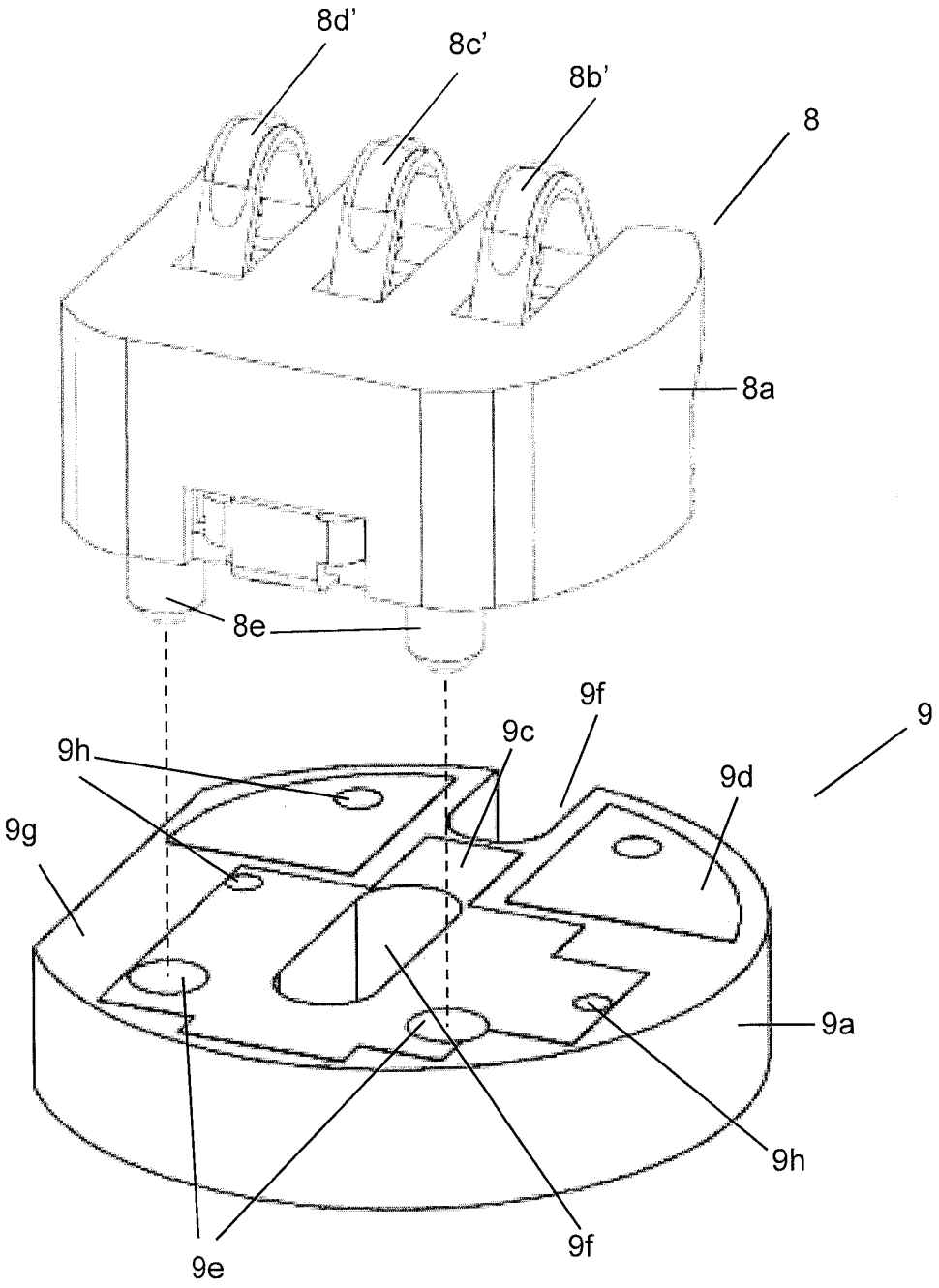
FIG. 12 shows how a custom three pin connector (8) may be mounted to an optional soldering plate (9).
Figure 13:
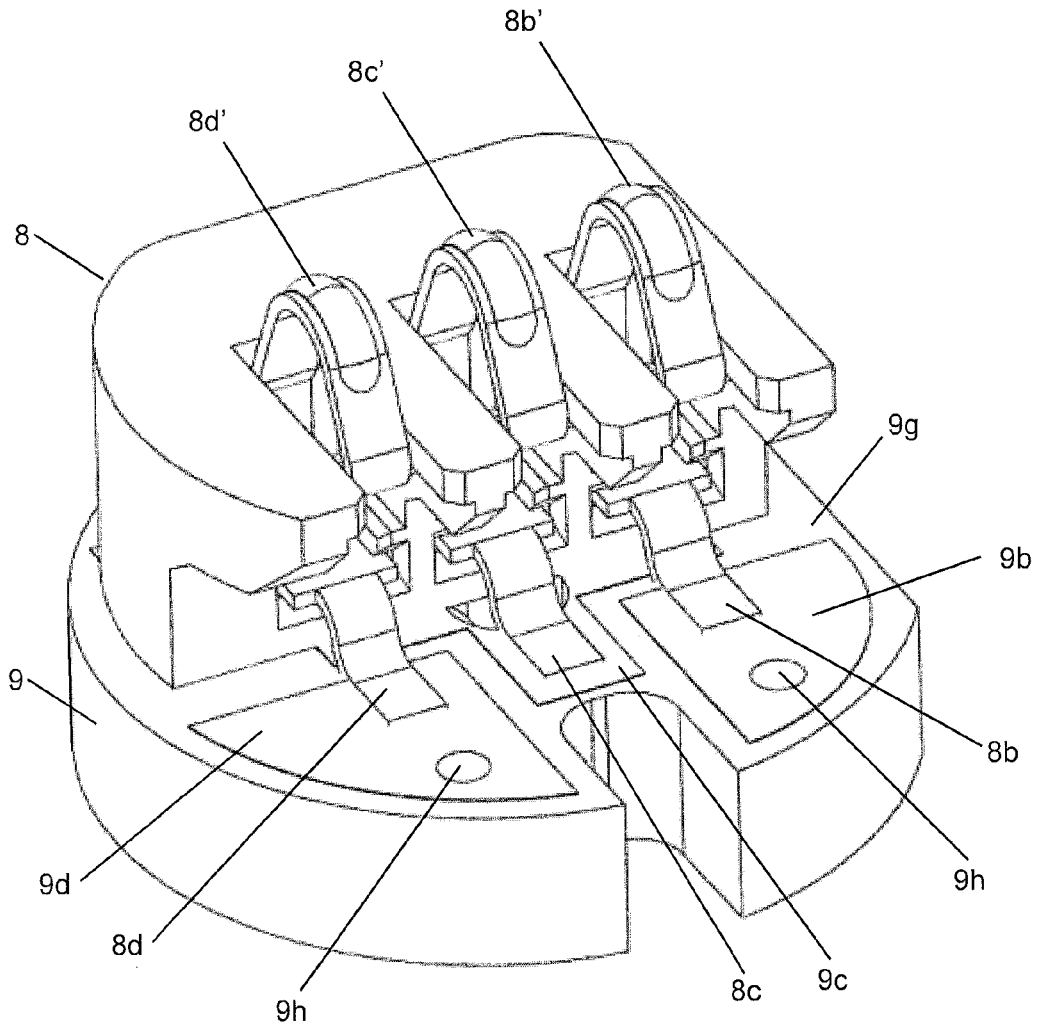
FIG. 13 is a perspective view of the a custom three pin connector (8) mounted to a soldering plate (9).

The control board subassembly (2) further comprises a custom 3-pin connector (8), which is attached to the distal end (6*f*) of the upper PCB (6). The purpose of the custom 3-pin connector is to effect a removable connection between the upper PCB of the handle subassembly (1), and a lower PCB (16) of the container subassembly (10) (see below). A soldering plate (9) may be used to hold together the upper printed circuit board and the soldering plate, as well as to effect various connections between the upper PCB and the 3-pin connector. FIGS. 11-13 show a custom 3-pin connector (8) and soldering plate (9) in more detail.

The soldering plate (9) comprises a plastic base (9*a*) that has two opposing sides (9*g*, 9*g*'). Side (9*g*') is connected to the upper PCB (6) near the distal end (6*f*) of the upper PCB. Side (9*g*) is connected to the 3-pin connector (8). The base of the soldering plate has two holes (9*e*) for receiving positioning pins (8*e*) of the 3-pin connector, and two slots (9*f*) for receiving portions of the upper PCB.

One side (9*g*') of the soldering plate comprises soldering contacts (9*b*', 9*c*', 9*d*'). When assembled to the upper PCB (6), these contacts lie adjacent to corresponding contacts (6*b*', 6*c*', 6*d*') of the upper PCB (see FIGS. 9-10). A dollop of solder between each corresponding pair will fix the soldering plate to the upper PCB, and effect electrical connections. The other side (9*g*) of the soldering plate (9) comprises soldering contacts (9*b*, 9*c*, 9*d*). When assembled to the custom 3-pin connector (8), these contacts lie adjacent to corresponding leads (8*b*, 8*c*, 8*d*) of the 3-pin connector (see FIG. 13). A dollop of solder between each corresponding pair will fix the soldering plate to the 3-pin connector, and effect electrical connections. Corresponding soldering contacts (9*b*-9*b*', 9*c*-9*c*', 9*d*-9*d*') of the soldering plate are electrically connected to each other through channels (9*h*) which pass through the soldering plate, from one side to the other.

The 3-pin connector (see FIG. 11) comprises a plastic casing (8*a*) that supports the three flexible, metallic leads (8*b*, 8*c*, 8*d*). Lead (8*b*) is negative and receives power from the soldering contact (9*b*) of the soldering plate (9), and conducts it toward a heat generating portion (16*j*). Lead (8*c*) conducts power between heat sensor (16*e*), and control elements located on the upper printed circuit board (6). Metallic lead (8*d*) is positive and receives power from the heating elements and heat sensors (see below), and coveys it through soldering contact (9*d*), back to the upper PCB toward contact (6*d*) and positive battery terminal (7*d*). The casing (8*a*) features two positioning pins (8*e*) which are for positioning the 3-pin connector on the soldering plate (9). FIG. 13 shows the 3-pin connector (8) mounted onto the soldering plate (9).

Each of the three metallic leads (8*b*, 8*c*, 8*d*) of the 3-pin connector are shaped as shown, so that the folded over portions (8*b*', 8*c*' 8*d*') of the leads represent the most distal extension of the control board subassembly (2). As is clear in FIG. 7, in the final assembly, the custom 3-pin connector (8) is located well inside the stem (3) and well inside the handle (1*d*), so that the folded over portions (8*b*', 8*c*' 8*d*') of the metallic leads (8*b*, 8*c* 8*d*) do not extend beyond the distal end (3*f*) of the stem, nor the distal end (1*f*) of the handle. Nevertheless, the folded over portions of the custom 3-pin connector are able to establish electrical contact with the lower PCB (16) which is located in the container subassembly (10) (see below). Also, the metallic leads (8*b*, 8*c* 8*d*) of the custom 3-pin connector are flexible, so that they may maintain physical contact with the lower PCB (16) without damaging either component.

The control board subassembly (2) may optionally comprises electric components that are not part of a heating circuit. These may offer a user other functionality or convenience. For example, electric circuits may be provided for a vibration system, a lighting system, a sound system, etc.

The handle subassembly (1) may generally be assembled in the following order. The upper PCB (6) is prepared with the desired electronic elements laid out thereon. A soldering plate (9) and custom 3-pin connector (8) are soldered to the upper PCB to form the control board subassembly (2). The control board subassembly is positioned into a stem (3) and locked in place via the cutout (6*g*) and clip (3*g*) design described above. A ring magnet (4) is disposed over the distal end (3*f*) of the stem (3) and retained there by suitable means, such as described above. The stem, with magnet and control board subassembly, is inserted into the first body section (1*a*), such that the linear rib (3*t*) of the stem is received into the linear slot (1*t*) of the first body section. The clip (5*g*) on the end of the battery lead (5) is then fastened to the electrical contact (6*b*) located on a side of the upper PCB (6), and the coiled portion (5*a*) of the battery lead is positioned inside the first body section. Next, the second body section (1*b*) is positioned on the first body section (1*a*) so that the linear and arcuate ribs (3*s*, 3*r*) of the stem (3) are received into linear and arcuate slots (1*s*, 1*r*) of the second body section. The second body section (1*b*) is joined on the first body portion (1*a*) by any suitable means, such as snap fitments, adhesive or welding. Preferably, the means of attachment is permanent, such as adhesive or welding. The LED reflector (1*i*) is inserted into the hole (1*j*) in the first body section (1*a*), and a battery (or batteries, 7) is inserted into the battery compartment (1*g*). The door (1*c*) is positioned to close the compartment. The handle subassembly is complete and represented in FIG. 26 (right side). It may be noted that the handle subassembly does not comprise a completed heating circuit, so that even if a battery (7) is positioned in the battery compartment (1*g*) and the on-off control (1*h*) is activated, no substantial heat will be produced. There is no complete heating circuit until the reusable handle subassembly (1) is joined to a disposable container subassembly (10) in the proscribed manner (see below). This is an advantage over previous heating applicators, such as those seen in U.S. Pat. No. 8,950,962, U.S. Pat. No. 8,585,307, and U.S. Pat. No. 8,262,302, because in the present invention heat cannot be generated and power cannot be dissipated in the heating circuit when the disposable and reusable components are not fully assembled.

The Disposable Container Subassembly

Figure 14:
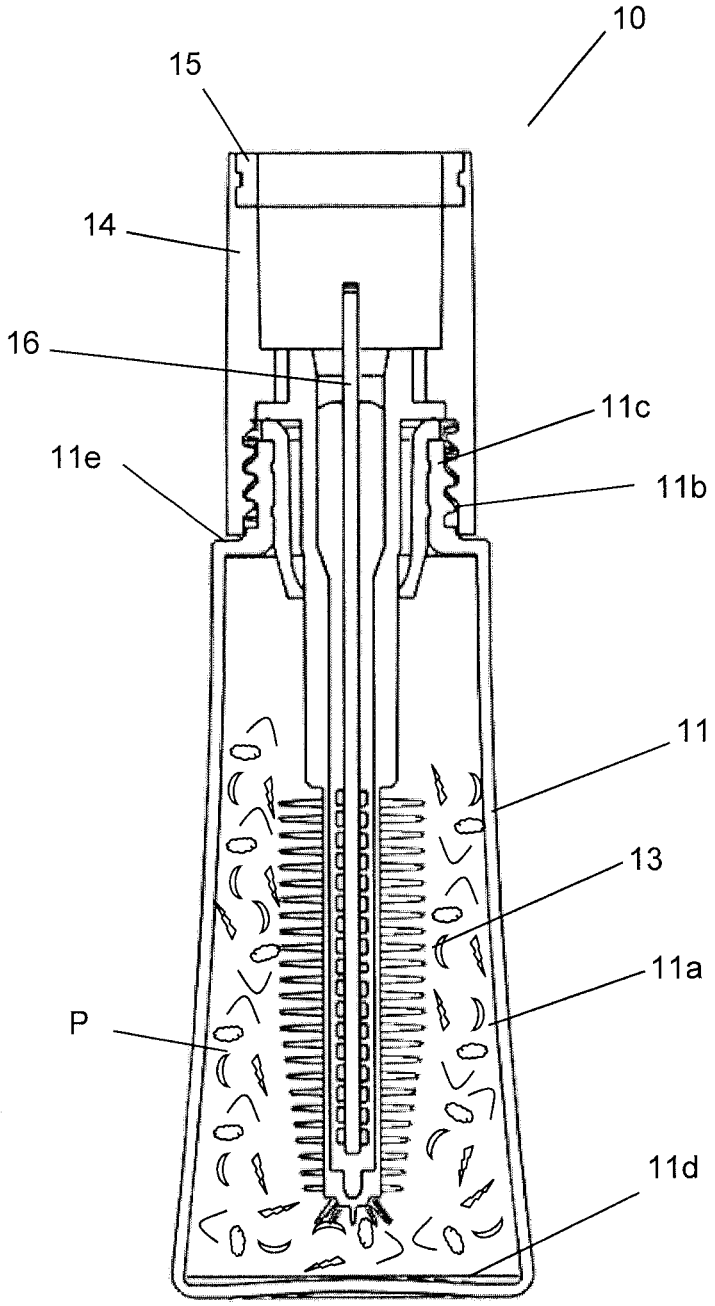
FIG. 14 is a cross section of an elevation view of a disposable container subassembly (10) according to the present invention.
Figure 15:
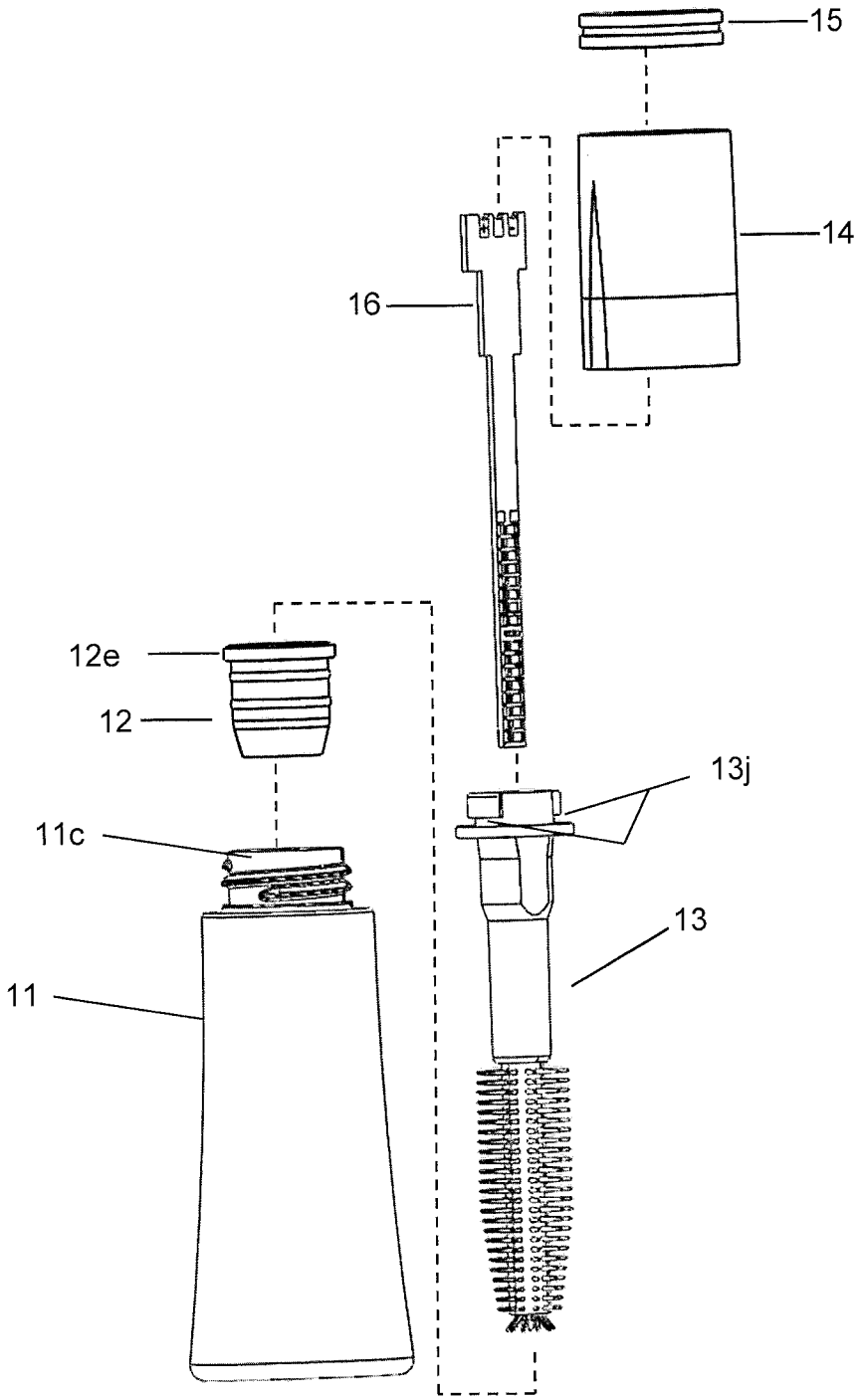
FIG. 15 is an exploded view of one embodiment of a disposable container subassembly (10).

The container subassembly (10) is detachably connected to the handle subassembly (1). A container subassembly according to the invention is shown in FIG. 14, and an exploded view is shown in FIG. 15. The container subassembly comprises a container (11), a hollow applicator head (13), a collar (14), a metal insert (15) and a printed circuit board (PCB), hereinafter known as the lower printed circuit board or lower PCB (16). A wiper (12) is optional, but preferred.

The container comprises a reservoir (11*a*) that is suitable for holding a mascara product, and a neck (11*c*) that has structure for attaching a closure. The most common structure for closure attachment may be screw threads (11*b*), but lug style engagements, snap fitments, and friction fitments may also be imagined. The interaction of the container (11) and an optional wiper (12) may be of a type well known in the art. For example, the wiper may sit in the neck of the container, while a flange (12*e*) of the wiper rests on the top of the neck. The container and wiper are suitable for receiving an applicator head (13), as is commonly done in the art. The wiper is effective to remove excess product from the applicator head, and evenly distribute product over a working surface (13*b*) of the applicator head. When the product in the reservoir is exhausted, the whole container subassembly, including the hollow applicator head and lower PCB (16), is intended to be discarded. Preferably, the disposable container subassembly is replaced regularly. For example, every four weeks, preferably every three weeks, more preferably every two weeks. Correspondingly, an unused reservoir holds enough product for no more than four weeks of daily applications, preferably for no more than three weeks of daily applications, and more preferably for no more than two weeks of daily applications. By limiting the amount of product provided in the reservoir, there is less chance that the product in the reservoir will dry out and become unusable. In some preferred embodiments of the present invention, multiple container subassemblies (10) are sold with one reusable handle subassembly.

Figure 16:
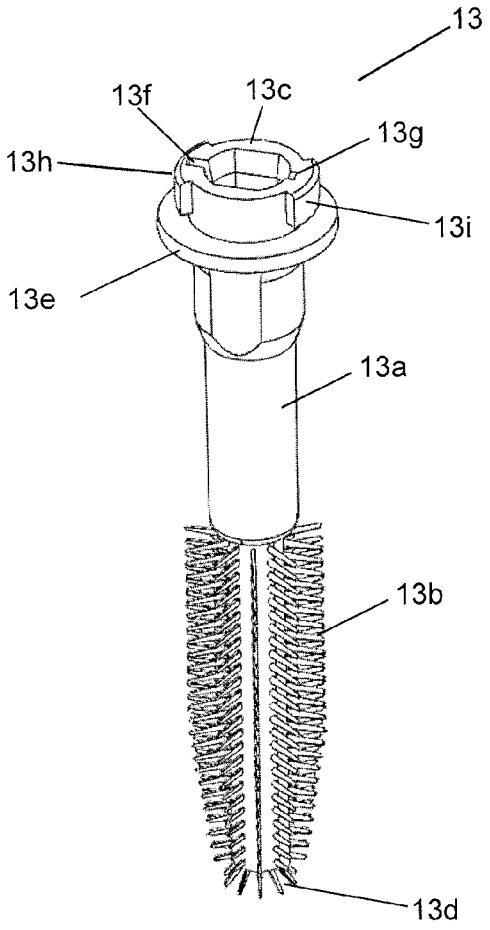
FIG. 16 depicts a hollow applicator head (13).
Figure 17:
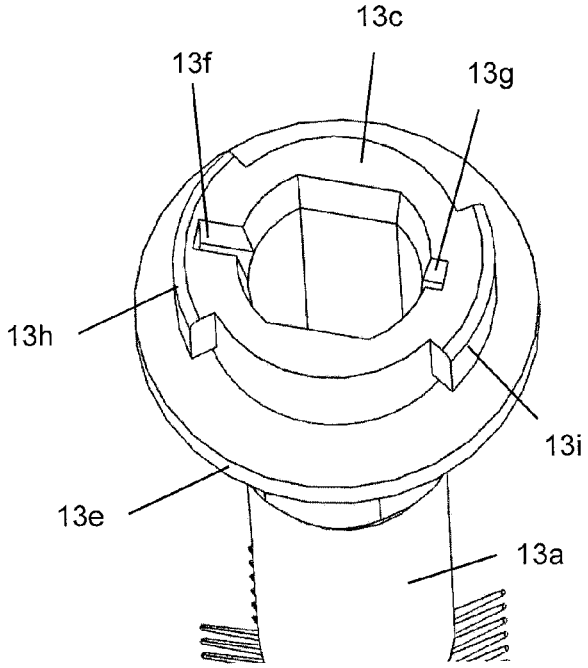
FIG. 17 is a close up of the proximal end of the applicator head of FIG. 16.

Referring to FIG. 16, the hollow applicator head (13) if formed as a hollow rod (13*a*) having a proximal end (13*c*) and a distal end (13*d*). Preferably, the hollow applicator head is molded as one integral unit. The hollow interior of the rod is suitable for receiving into itself a portion of the lower PCB (16). Slots (13*f*, 13*g*) are provided on the proximal end of the hollow rod for ensuring that the lower PCB (16) adopts a specific orientation with respect to the hollow rod (see FIG. 17). Also near the proximal end are two arcuate protrusions (13*h*, 13*i*) which are not identical. Arcuate protrusion (13*h*) is larger than arcuate protrusion (13*i*). For example, the larger protrusion may subtend an angle of 78°, while the smaller protrusion subtends an angle of 68°. Below the arcuate protrusions is a gap (13*j*), and below the gap is a flange (13*e*). The gap may be seen easily in FIG. 15.

Toward its distal end (13*d*), the hollow rod (13*a*) supports a working surface (13*b*). By "working surface" we mean that part of the applicator head (13) that is designed to take product out of the reservoir and apply it to a consumer. A typical form of the working surface may be a bristle-type mascara brush (as shown), but the invention is not so limited. The working surface of the applicator head is able to pass through the wiper (12), and into the reservoir (11*a*). If the reservoir is full of product (P), then the working surface is immersed in the product and able to take up product. The flange (13*e*) limits the depth of insertion of the applicator head into the reservoir (11*a*), and causes the proximal end (13*c*) of the applicator head to remain outside of the reservoir. When the flange rests on top of the wiper (12), then the applicator head cannot be further inserted into the reservoir, and preferably, the distal end of the applicator head is near the bottom (11*d*) of the reservoir, more preferably the distal end of the applicator head is just contacting the bottom of the reservoir, to allow maximum evacuation of product.

Figure 18:
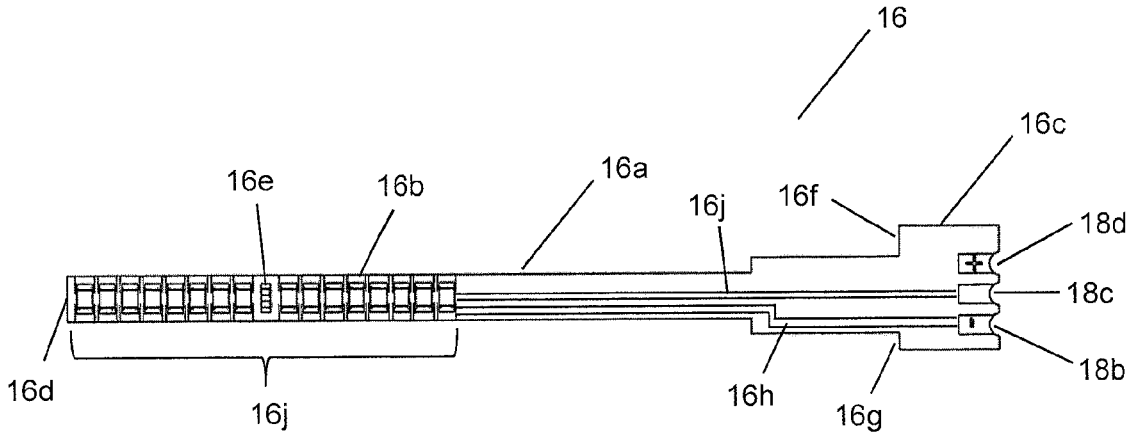
FIG. 18 depicts one embodiment of a lower printed circuit board (16).

Referring to FIG. 18, the lower PCB (16) comprises an elongated substrate (16*a*) that has a proximal end (16*c*) and a distal end (16*d*). A heat generating portion (16*j*) is located near the distal end of the lower PCB, on one or both sides; preferably on both sides of the PCB. Preferably, the heat generating portion comprises a temperature sensor (16*e*), such as a thermistor. Preferably, the temperature sensor is located near the middle of the heating generating portion, as shown in FIG. 18. The proximal end of the lower PCB supports three metallic contacts. In FIG. 18, the left-most contact (18*d*) is positive (leading back to the battery 7), the right-most contact (18*b*) is negative (power coming from the battery) and the middle contact (18*c*) conveys heat sensor information. Printed conductor (16*h*) conveys power between the negative contact and the heating generating portion (16*j*). Printed conductor (16*i*) conveys power between the sensor contact and the temperature sensor (16*e*). A conductor leading from the positive contact (18*d*) is located on the back of the elongated substrate (16*a*). Because the lower PCB is disposable, it is preferable if the lower PCB comprises only the heating elements and the electrical path to and from the heating elements. Specifically, it is preferably if no circuit control elements are included on the lower PCB (16). Preferably, all circuit control elements are placed on the upper PCB (6). The lower PCB may have any shape or dimensions that are convenient to manufacture and assemble into the applicator head (13) and collar (14). The lower PCB comprises a substrate that is non-conductive to electricity under the conditions of normal or expected use. Suitable substrate materials include, but are not limited to, epoxy resin, glass epoxy, Bakelite (a thermosetting phenol formaldehyde resin), and fiberglass. The substrate may be about 0.25 to 5.0 mm thick, preferably 0.5 to 3 mm, more preferably, 0.75 to 1.5 mm thick. Portions of one or both sides of the substrate may be covered with a layer of copper, for example, about 35 μm thick.

Figure 19:
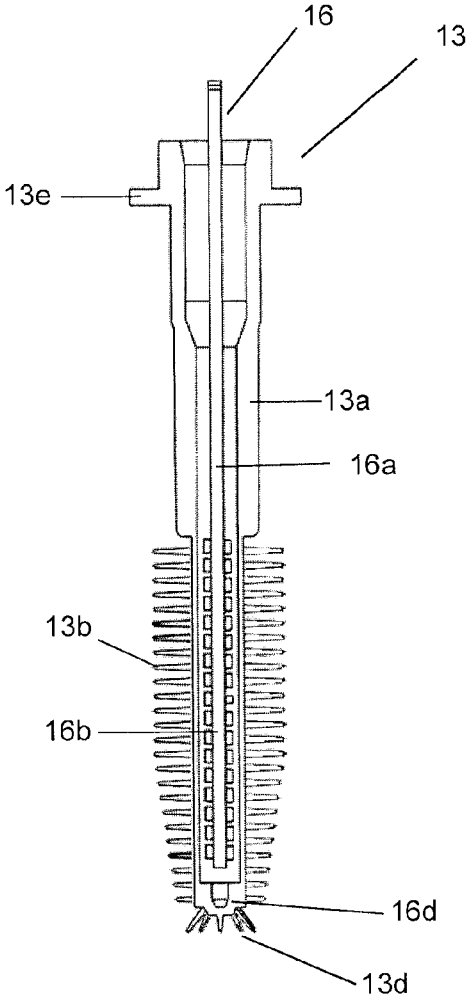
FIG. 19 shows the lower printed circuit board (16) fitted into the hollow applicator head (13).
Figure 20:
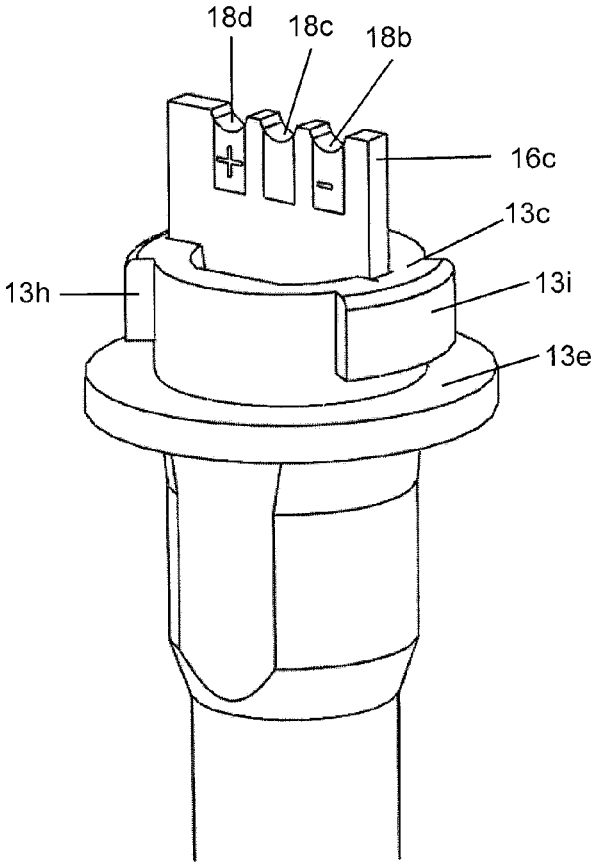
FIG. 20 is a close up of the proximal end of the lower printed circuit board (16) and hollow applicator head (13) of FIG. 19.

The lower PCB (16) is designed to be inserted into the hollow applicator head (13). Referring to FIG. 19, when the elongated substrate (16*a*) is fully inserted into the hollow rod (13*a*), then the distal end (16*d*) of the lower PCB is near the distal end (13*d*) of the hollow rod, and the heat generating portion (16*j*) of the elongated substrate is located immediately under the working surface (13*b*) of the hollow applicator head. Preferably, no part of the heat generating portion is located at a level above the working surface, because such part would be less efficient to heat the working surface. Referring to FIG. 20, when the lower PCB (16) is fully inserted into the hollow rod, then the three contacts (18*b*, 18*c*, 18*d*) on the proximal end (16*c*) of the lower PCB (16) extend above the proximal end (13*c*) of the hollow applicator head.

As noted above, slots (13*f*, 13*g*) are provided on the interior surface of the hollow applicator head (13) for ensuring that the lower PCB (16) adopts a specific orientation with respect to the hollow applicator head. Referring to FIG. 18, note that the proximal end (16*c*) of the lower PCB extends more to the left (16*f*) than to the right (16*g*). Correspondingly, slot (13*f*) is wider, and slot (13*g*) is narrower (see FIG. 17) for receiving the proximal end (16*c*) of the lower PCB in only one orientation. This ensures that the lower PCB can only be fully inserted into the hollow applicator head in exactly one orientation. FIGS. 19 and 20 depict the lower PCB (16) fully inserted into the applicator head (13). Additional features near the proximal end of the applicator head are designed to attach the applicator head to the collar (14).

Referring to FIG. 19, in general, air gaps between the heat generating portion (16*j*) and the inner surface of the distal end (13*d*) of the hollow rod (13*a*), decrease the efficiency of heat transfer to the working surface (13*b*). Therefore, it is preferable if there are as few air gaps as possible. This will improve the efficiency of heat transfer through the applicator head, from the inside, going out. In one embodiment of the present invention, the heat generating portion (16*j*) is immersed in a viscous heat transfer material. Preferably, a quantity of viscous heat transfer material (designated M, in FIG. 27) is inserted into the distal end (13*d*) of the hollow applicator head (13), such that when the distal end (16*d*) of the lower PCB (16) is inserted into the hollow applicator head, the viscous heat transfer material flows over the heat generating portion and effectively fills all air gaps. To prevent difficulties in assembly, the amount of heat transfer material inserted into the hollow applicator head must be controlled, but will typically be about half of the height of the working surface (13*b*).

With time and heat, the heat transfer material may or may not harden over the heat generating portion. Examples of useful heat transfer materials include one or more thermally conductive adhesives, one or more thermally conductive epoxies or a combination of these. An example of a thermally conductive adhesive is Dow Corning® 1-4173 (treated aluminum oxide and dimethyl, methylhydrogen siloxane; thermal conductivity=1.9 W/m·K; shore hardness 92A). An example of a thermally conductive encapsulating epoxy is 832TC (available from MG Chemicals, Burlington, Ontario; thermal conductivity=0.682 W/m·K; Shore hardness 82D). In one working embodiment of the invention, 0.1±0.005 grams of 832TC is inserted into the distal end (13*d*) of the hollow rod (13*a*). For the heat transfer material, a higher thermal conductivity is preferred over a lower thermal conductivity.

Figure 21A:
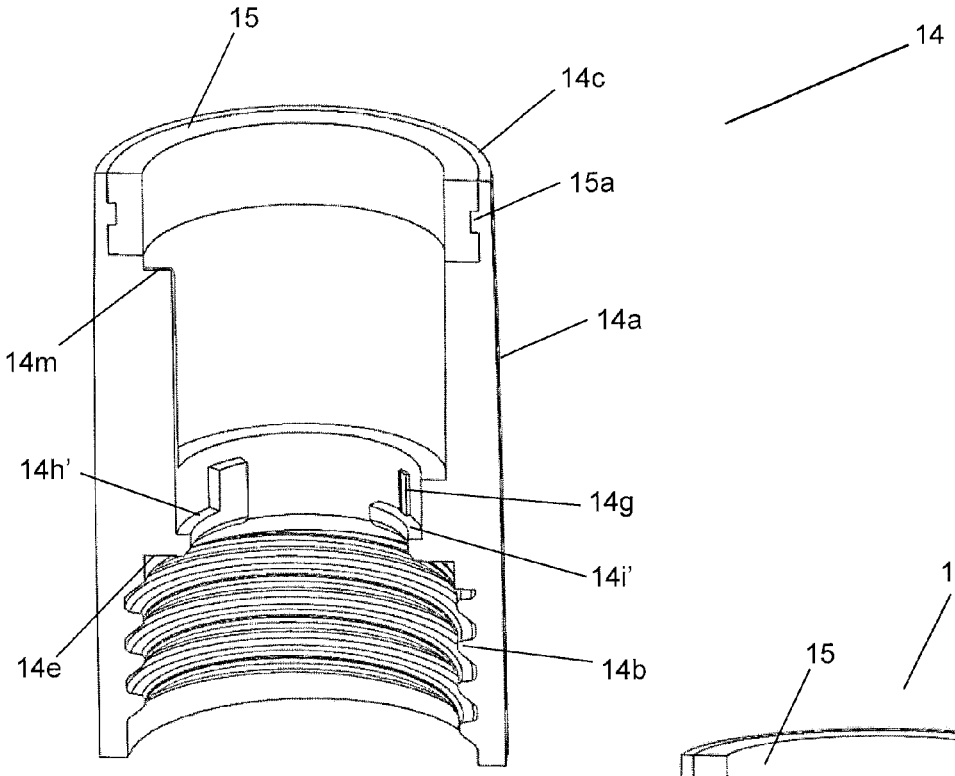
FIGS. 21*a* and 21*b* are cross sectional views of one embodiment of a collar (14) and metal insert 15.
Figure 21B:
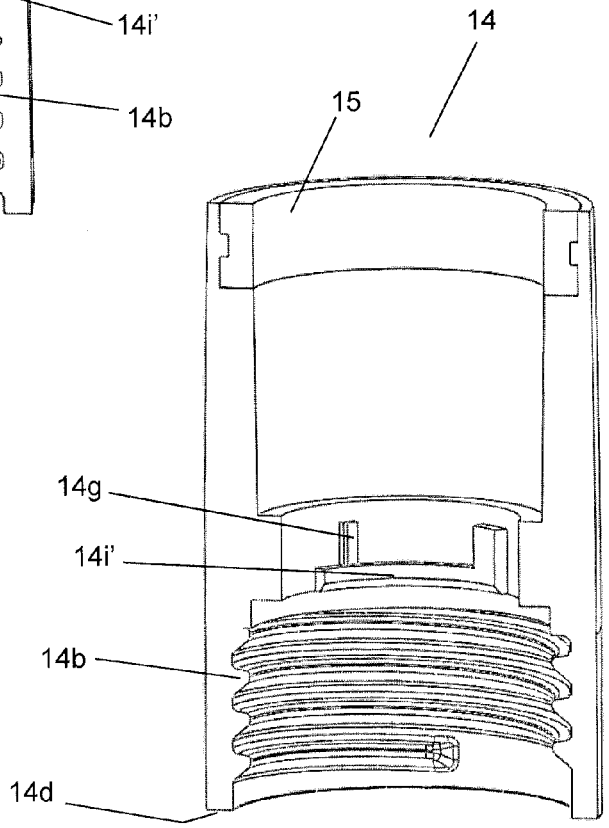

In a preferred embodiment, the collar (14) is shown as a hollow cylinder (see FIGS. 21*a*, 21*b*). The collar has a vertical wall (14*a*) that comprises a opened proximal end (14*c*) and an opened distal end (14*d*). Preferably, the outer diameter of the wall near the distal end (14*d*) of the collar (14) is a little less than the outer diameter of the shoulder (11*e*) of the container (11, see FIGS. 13 and/or 24). Near the proximal end of the collar, retained on the interior thereof, is a metal insert (15). The metal insert may be positioned in the collar after the collar is molded, or the metal insert may be overmolded with the collar, and may have a circumferential recess (15*a*) for a better retention in the collar after overmolding. This metal insert is positioned to cooperate with the ring magnet (4) which is disposed over the distal end (3*f*) of the stem (3).

The (14) collar is able to attach to and detach from the neck (11*c*) of the container (11), at will. As such, the distal end (14*d*) of the collar has complimentary structure that is designed to cooperate with structure of the container (11). The most common structure for closure attachment may be screw threads, but lug style engagements, snap fitments, and friction fitments may also be imagined. As shown, screw threads (14*b*) are designed to cooperate with the screw threads (11*b*) of the neck (11*c*), and are located nearer to the distal end of the collar, so that the collar may be attached or detached from the container, at will.

Figure 22:
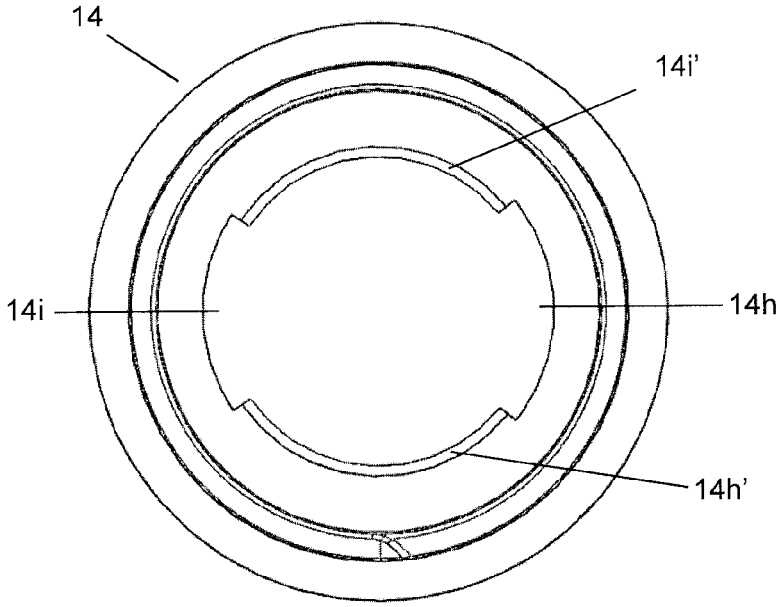
FIG. 22 is a bottom plan view of the collar (14) of FIGS. 21*a* and 21*b*.
Figure 24:
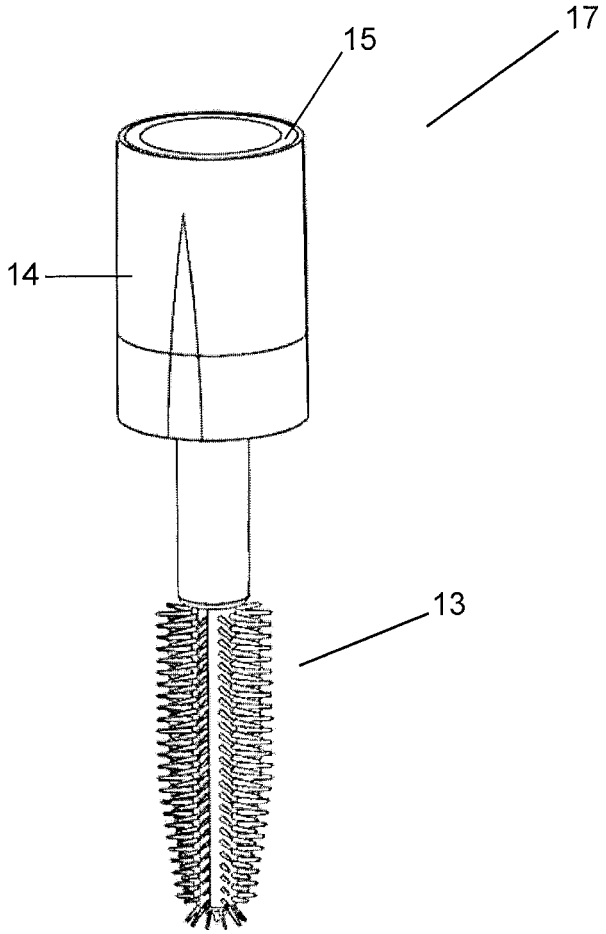
FIG. 24 depicts the collar-applicator head unit (17), which comprises the hollow applicator head (13), collar (14), metal insert (15) and lower printed circuit board (16).

Once the lower PCB (16) is positioned in the applicator head (13), as discussed above, then the proximal end (13*c*) of the applicator head is inserted into the collar (14). The collar is designed to receive the proximal end (13*c*) of the applicator head with the three metallic contacts (18*b*, 18*c*, 18*d*) protruding above the applicator head, in a way that ensures that the hollow applicator head adopts a specific orientation with respect to the collar. The following describes one type of structure for retaining the applicator head in the collar. Other means will be possible. Above the threads (14*b*) of the collar (14) is land area (14*e*), from which arise two arcuate protrusions (14*h*', 14*i*'). These protrusions define two arcuate spaces (14*h*, 14*i*; see FIG. 22) that correspond to the two arcuate protrusions (13*h*, 13*i*) of the applicator head (13). That is, arcuate space (14*h*) is larger than arcuate space (14*i*). Arcuate protrusion (13*h*) can fit into arcuate space (14*h*), but not into arcuate space (14*i*), which is only designed to receive arcuate protrusion (13*i*). This ensures that the applicator head and collar can have only one relative orientation. The proximal end (13*c*) of the applicator head (13) is inserted into the collar such that arcuate protrusions (13*h*, 13*i*) of the applicator head enter the arcuate spaces (14*h*, 14*i*) of the collar, respectively. The applicator head is inserted until the flange (13*e*) of the applicator head contacts the land area (14*e*) of the collar. At this point, the gap (13*j*) of the applicator head is aligned with the arcuate protrusions (14*h*', 14*i*') of the collar. With a quarter twist of the applicator head relative to the collar, the arcuate protrusions of the collar come to rest between the flange (13*e*) and the arcuate protrusions (13*h*, 13*i*) of the applicator head. In the process, each arcuate protrusion (13*h*, 13*i*) of the applicator head is made to pass over a locking bump (14*f*, 14*g*), which inhibits the accidental separation of the applicator head and collar. In this configuration, the proximal end (13*c*) of the hollow applicator head (13) is retained in the hollow collar (14), so that the applicator head depends from the collar, and the applicator head (13), collar (14), metal insert (15) and lower PCB (16) are effectively one unit. This unit, the collar-applicator head unit (17, see FIG. 24), can be screwed onto and off of the container (11) at will. The metal contacts (18*b*, 18*c*, 18*d*) of the lower PCB (16) are situated within the collar, that is they extend above the proximal end (13*c*) of the hollow applicator head (13), but do not protrude above the proximal end (14*c*) of the collar (14). The applicator head, collar and lower PCB are constrained to be assembled in only one configuration. This constraint will facilitate electrical contact between the lower PCB and the upper PCB (6) through the metallic leads (8*b*, 8*c* 8*d*) of the custom 3-pin connector (8).

When assembled as descried above, the collar (14), applicator head (13) and neck (11*c*) of the container (11) cooperate to seal off the reservoir (11*a*) from the ambient environment. The land area (14*e*) of the collar is positioned so that the flange (13*e*) of the applicator head will bear down on the flange (12*e*) of the wiper (12), before the distal end (14*d*) of the collar contacts the shoulder (11*e*) of the container (11). This will permit a tight seal between the flange of the applicator head and the flange of the wiper (12*e*). Preferably, the seal is fluid tight. By "fluid tight", we mean a seal that is sufficiently tight to prevent product from leaking out between two sealing surfaces. Recall that the applicator head and collar are hollow, and their interiors are exposed to the ambient atmosphere. If the applicator head is fashioned from sufficiently vapor impermeable material, then a tight seal between the flange of the applicator head will protect the contents of the reservoir (11*a*) from losses due to water transmission. If however, water loss through the walls of the applicator head is a problem, then other means of preserving the product should be undertaken. For example, if water transmission is a problem, then the collar-applicator head unit may be kept separate from the container during distribution and sale. In this case, an ordinary screw cap may be provided on the container. Upon purchase, the consumer can remove the ordinary screw cap from the container, and screw the collar-applicator head unit onto the container, to give the configuration of FIG. 14.

The container subassembly (10) may generally be assembled in the following order. The lower PCB (16) is prepared with the desired layout of heat elements. A molded hollow applicator head (13) is filled with a quantity of heat transfer material, M, and the lower PCB is inserted into the hollow applicator head, registering in the specified orientation. The collar (14) is prepared with a metal insert (15) affixed near the proximal end (14*c*) of the collar. The proximal end (13*c*) of the applicator head is inserted into the collar (14) such that arcuate protrusions (13*h*, 13*i*) of the applicator head enter the arcuate spaces (14*h*, 14*i*) of the collar, respectively, and with a quarter twist of the applicator head relative to the collar, the two components are joined into a collar-applicator head unit (17). The reservoir (11*a*) of a container (11) is filled with product (P). A wiper (12) is positioned in the neck (11*c*) of a container. The applicator head (13) is inserted into the reservoir, immersed in product, and the collar (14) is screwed down onto the container (11).

The Complete Assembly

Figure 25:
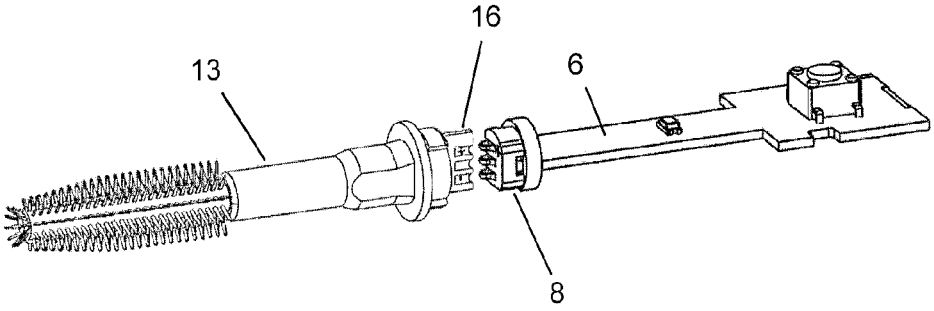
FIG. 25 depicts the joining of the upper printed circuit board (6) and the lower printed circuit board (16).

The lower printed circuit board (16), the three metallic contacts (18*b*, 18*c*, 18*d*), and the heat generating portion (16*j*) do not form a closed electrical circuit. What remains is to securely connect the reusable handle subassembly (1) to the disposable container subassembly (10) such that an electrical connection is established between the three metal contacts (18*b*, 18*c*, 18*d*) of the lower printed circuit board (16) and the three metallic leads (8*b*, 8*c*, 8*d*) of the upper printed circuit board (6). To complete a heating circuit, the three metal contacts of the lower PCB must be correctly mated (negative to negative, sensor contact to sensor contact, positive to positive,) to the metallic leads of the custom 3-pin connector (8). This is shown conceptually in FIG. 25.

Figure 23:
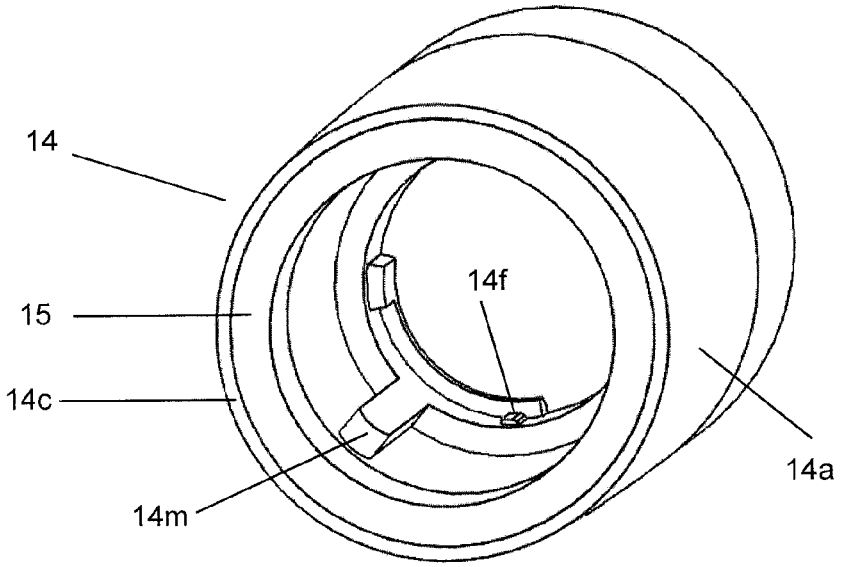
FIG. 23 is a perspective view of the interior of the collar (14) through its proximal end (14*c*).
Figure 26:
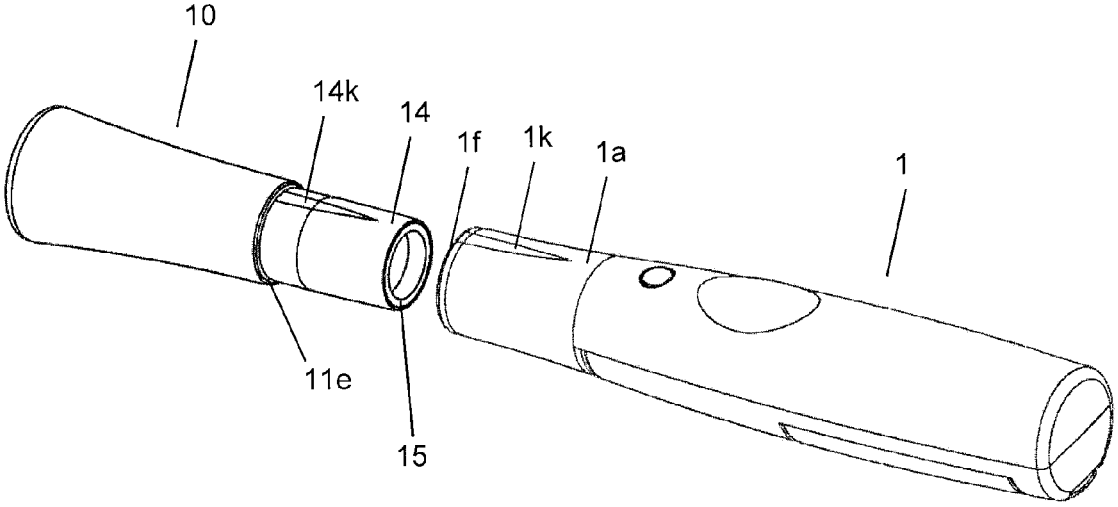
FIG. 26 depicts the joining of the handle subassembly (1) and the container subassembly (10).

In the embodiment of FIG. 26, the hollow collar (14) of the container subassembly (10) is able to be inserted into the handle (1*d*) by sliding in between the first body section (1*a*) and the stem (3) of the handle subassembly (1). The distal end (3*f*) of the stem must be able to slide into the collar. To facilitate this, the distal end of the stem (3) of FIG. 6 has one longitudinal slot (3*m*). The collar (14) of FIG. 23 has one longitudinal guide member (14*m*). The stem may only slide into the collar when the longitudinal guide member is aligned to slide within the slot. This prevents any misalignment of the metal contacts (18*b*, 18*c*, 18*d*) of the lower PCB with the metallic leads (8*b*, 8*c*, 8*d*) of the custom 3-pin connector (8). Also, once the longitudinal member is in the slot, it is not possible to rotate the collar with respect handle subassembly, which might otherwise damage the leads and contacts. Because the slot (3*m*) and guide member (14*m*) are not readily visible to a user, the collar (14) and the first body section (1*a*) may be provided with indicia (14*k*, 1*k*, respectively) to help the user insert the guide member into the slot (see FIG. 26).

As the handle subassembly and the collar get close, the magnetic force of attraction of the ring magnet (4) for the metal insert (15) joins these two parts together in a detachable manner. The attraction is sufficiently strong to secure the collar-applicator head unit to the handle subassembly, meaning that if the handle is rotated with respect to the container (10), the collar will unscrew from the container, and the applicator head can be lifted out of the reservoir by the handle subassembly.

The retaining force of the ring magnet (4) for the metal insert (15) is preferably between about 4-9 newton. Examples of potentially useful magnets include hard ferrite magnets, which are cost effective; AlNiCo (aluminum-nickel-cobalt) magnets, which are permanent metallic magnets; SmCo (samarium-cobalt) magnets, which are permanent metallic rare earth magnets. One preferred magnet is a ring of NdFeB (neodymium-iron-boron), having a magnet grade of N45, a preferred internal diameter of less than about 12 mm, a preferred external diameter of less than about 15 mm, and a preferred height of less than about 10 mm. Of course depending of the packaging design these dimensions can be adjusted. N45 is a standard neodymium-iron-boron grade for which the maximum energy product ($BH_{max}$) ranges from 43 to 46 MGOe (megaGause-Oersteds; 1 MGOe is approximately equal to 7957.74715 J/m$^3$). Potentially useful magnets may have a maximum energy product in the range of about 10 to about 100 MGOe, preferably about 25 to about 75 MGOe, more preferably about 40 to about 50 MGOe. Preferably, the ring magnet (4) will have an axial magnetization.

The collar (14) and the first body section (1*a*) may preferably contain indicia (14*k*, 1*k* respectively; see FIG. 26) that guide the assembly of the handle and container subassemblies to ensure that metallic leads (8*b*, 8*c*, 8*d*) make firm contact with metal contacts (18*b*, 18*c*, 18*d*), respectively. When the collar is fully inserted into the handle subassembly (1), metal contacts (18*b*, 18*c*, 18*d*) of the lower PCB make firm electrical contact with metallic leads (8*b*, 8*c*, 8*d*) of the custom 3-pin connector. The upper PCB (6) and the lower PCB (16) are electrically joined to form complete heating and control circuits. Neither the handle subassembly by itself, nor in the container subassembly by itself comprises a complete heating circuit, meaning that neither subassembly can generate heat without the other. A complete heating circuit is not present until the metal contacts (18*b*, 18*c*, 18*d*) of the lower PCB make firm electrical contact with metallic leads (8*b*, 8*c*, 8*d*) of the custom 3-pin connector. This is an advantage over previous heating applicators, such as those seen in U.S. Pat. No. 8,950,962, U.S. Pat. No. 8,585,307, and U.S. Pat. No. 8,262,302, because in the present invention heat cannot be generated and power cannot be dissipated in the heating circuit when the disposable and reusable components are not fully assembled.

As the handle and container subassemblies are being joined, the distal end (1*f*) of the handle subassembly approaches close to the shoulder (11*e*) of the container (11). Preferably, the shoulder and the distal end of the handle subassembly have the same outer diameter, so that when joined, the contour of the complete applicator system flows smoothly over its height, as shown in FIG. 1.

Consumer Operation

Figure 27:
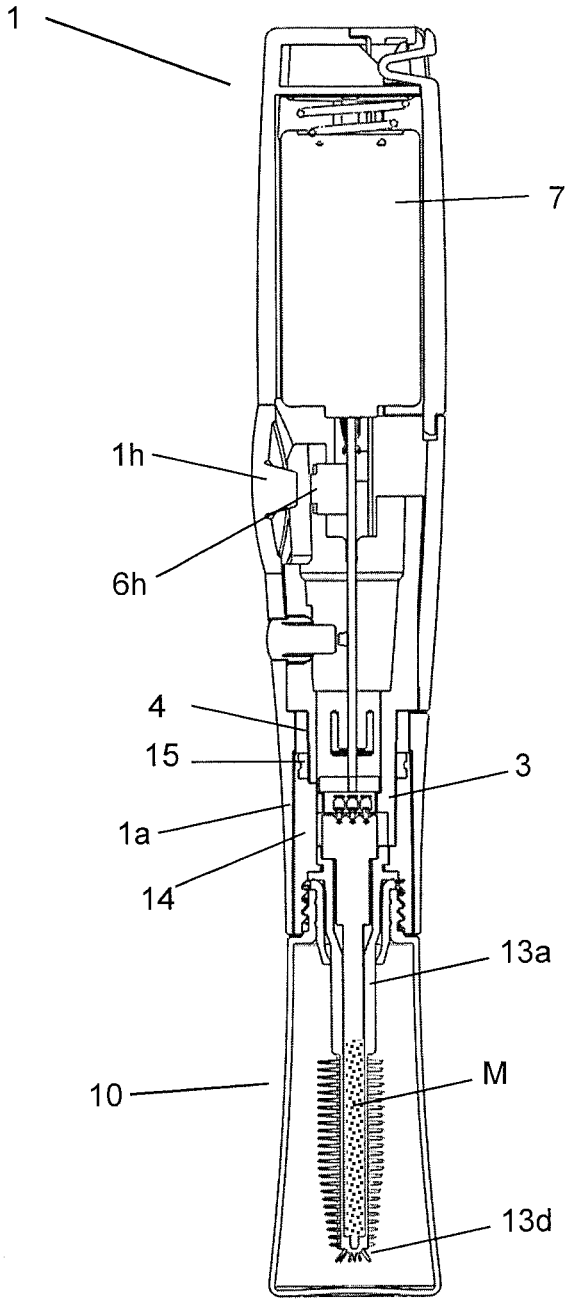
FIG. 27 is a cross section of an elevation view of a fully assembled heating applicator according to the present invention.
Figure 28:
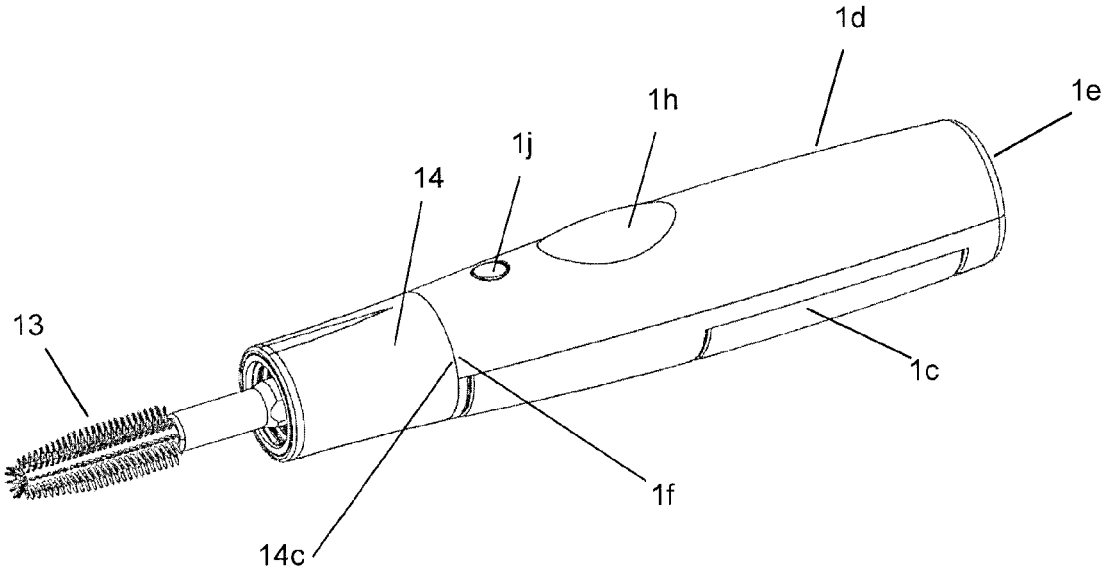
FIG. 28 shows the collar (14) and hollow applicator head (13) after being separated from the container (11) and attached to the handle subassembly (1) by magnetism.

Referring to FIG. 27, once the container (10) and handle (1) subassemblies are inserted into each other, the ring magnet (4) of the handle subassembly exerts an attractive force on the metal insert (15) of the collar (14). As far as rotation goes, the handle subassembly and the collar-applicator head unit move as one, because of the magnetic attraction and/or because of the interaction between the longitudinal slot (3*m*) of the stem (3) and the longitudinal guide member (14*m*) of the collar (14). So, if a consumer rotates the handle subassembly (1) counter-clockwise with respect to the container (11), then the collar-applicator head unit (17) will be unscrewed from the container. The magnetic force of attraction between ring magnet and the metal insert is sufficiently strong to keep the collar-applicator head unit rigidly attached to the handle subassembly, as shown in FIG. 28. At this point, the consumer can transfer product from the reservoir (11*a*) to a target surface, such as the eyelashes, in the usual manner of a wand-type applicator. When the consumer is done applying product, the applicator head can be returned to the reservoir and the collar can be screwed down onto the container until next use. When the contents of the container are exhausted, the collar-applicator head unit (17) is screwed down onto the container, and the handle subassembly (1) and the container subassembly (10) are pulled apart longitudinally, overcoming the magnetic force of attraction. The consumer discards the empty container subassembly, and substitutes a fresh one. Thus, the handle subassembly (1) may be reused, again and again. Throughout the life of the applicator system, the delicate circuit board substrates (6*a*, 16*a*) and components mounted thereon, are protected inside their respective subassemblies, which eliminates the possibility of breakage and improves the overall appearance of the heating applicator system.

Preferred Types of Heating Elements

A preferred embodiment of the heat generating portion (16*j*) is a bank of discrete fixed value resistive heating elements (16*b*), electronically arranged in series, parallel, or any combination thereof, and physically situated in two rows, one on either side of the lower PCB (16). The number of heating elements and their rated resistance is governed, in part, by the requirements of heat generation of the heating circuit. In one embodiment, forty-one discrete resistive heating elements of 5 ohms are uniformly spaced, 20 on one side of the PCB, and 21 on the other side. In another embodiment, twenty-three 6-ohm resistors are used, 11 on one side of the PCB, 12 on the other. In still another embodiment, forty-one 3-ohm resistors are used, 20 on one side, 21 on the other. The side with one fewer resistor leaves a space for a thermistor. Typically, a system for sampling a heated product according to the present invention might use 10 to 60 individual resistive heating elements (16*b*) having rated resistances from 1 to 100 ohms. However, these ranges may be exceeded as the situation demands. In one working embodiment of the invention, excellent results are achieved with thirty-five 75-ohm resistors arranged in parallel, 18 on one side, 17 on the other side. The equivalent resistance is about 2.14 ohms. If the voltage in the heating circuit is 2.7 volts (nominal 3.0 volt battery and some voltage drops in the control circuit), the power dissipated by the heating circuit is about 3.4 Watts. Typically, the overall (equivalent) resistance of all the heating elements might range from 1 to 10 ohms. However, this range may be exceeded as the situation demands.

One preferred type of resistive heating element (16*b*) is a metal oxide thick film resistor. These are available in more than one form. One preferred form is a high power thick film chip resistor, which is a thick film resistor reposed on a solid ceramic substrate, and provided with electrical contacts for surface mounting and protective coatings. Typically, chip resistors may be attached to the PCB by known methods. Geometrically, each chip may be approximately a solid rectangle. Such heating elements are commercially available, in a range of sizes. For example, KOA Speer Electronics, Inc. (Bradford, Pa.) offers general purpose thick film chip resistors, the largest dimension of which is on the order of 0.5 mm or less. By using resistors whose largest dimension is about 2.0 mm or less, better, in one embodiment 1.0 mm or less, even better, in another embodiment 0.5 m or less, the resistors can easily be arranged along the distal end of the lower PCB (16). Other useful suppliers include TE Connectivity (Berwyn, Pa.), Panasonic and Rohm.

A different form of metal oxide thick film resistor (not shown), is available as a silk screened deposit. Without a housing, such as the chip resistor, the metal oxide film is deposited directly onto the printed circuit board, using printing techniques. This is more efficient and flexible from a manufacturing point of view than welding chip resistors. The metal oxide film may be deposited on the PCB as one continuous heating element, or it may be printed as individual dots. Various metal oxides may be used in thick film resistor manufacture. One preferred material is ruthenium oxide ($RuO_2$). The individual dots may be printed as small as about 2.0 mm or less, more preferably 1.0 mm or less, most preferably 0.5 mm or less, and their thickness may vary. In fact, by controlling the size of the dots, one may alter the resistance of each dot. Also, the resistance of the thick film resistor, whether in a chip resistor or silk screened form, may also be controlled by additives in the metal oxide film. Typically, chip resistors and silk screened metal oxide dots of the type described herein, may have a rated resistance of 1 to 10 ohms.

Some Preferred Features of the Heating and Control Circuits

When the collar is fully inserted into the handle subassembly (1), then operating the on-off control (1*h*) activates the on-off switch (6*h*). When the switch is in the on position, the heating circuit is closed, and electricity flows from the battery (7) to the CPU (6*j*), to the heat generating portion (16*i*), and to the LED indicator light (6*i*). The LED shines through the hole (1*j*) in the first body section (1*a*), to signal a user that the applicator is heating up. The LED may have one status while the applicator is below a specified temperature, and a different status when the applicator is at or above a specified temperature. For example, the LED may blink while the applicator is below a specified temperature (for example, 40° C. or 45° or 50° C.). This condition will last for a specified period of time, for example, a user may wait for 30-60 seconds for the LED to stop blinking. Thereafter, the LED may remain lit when the applicator is at or above the specified temperature, and then blink again when the applicator is below the specified temperature. In one preferred embodiment of the invention, the LED indicator blinks until the thermistor senses an ambient temperature (temperature inside the applicator head) of 50° C. Thereafter, if allowed to continue, the LED will remain on and the applicator head will heat until the thermistor senses a temperature of 75° C., at which point the heating circuit will switch off. The LED will remain on until the temperature is below 50° C. or until the power is switched off. A preferred LED is Red LED 1206 20 mA 1.9V from Kingbright KP-3216SURCK.

Since a user needs time to apply the product after it has been heated, the circuit may be designed to turn off the heat generating portion some amount of time after the heat generating portion has reached a predetermined temperature. This length of time can be chosen according to need, but may typically be from about 2 to 5 minutes. Furthermore, depending on the level of sophistication employed, an overhead timer, such as the capacitor-based one, may require a reset period, following an automatic shut off, in which the heating elements cannot be activated (i.e. cannot be "turned on"). The reset time, which may be several seconds, allows the capacitors to discharge.

The heated mascara applicator system preferably includes a system that actively measures the output temperature and adjusts itself to meet a desired temperature. With such a system, the heating circuit can stay on for an extended period, holding a desired temperature, with no concern for overheating. Also, through the use of an automatic shut off and through the monitoring of the temperature of the heating elements, power utilization is significantly reduced. In this regard, the present invention may provide a commercially feasible, partially disposable, yet efficient heated mascara system.

The heated mascara applicator may further include a system for monitoring and maintaining an output voltage of the power source. For example, batteries are rated with a nominal voltage, such 3 volts, but there is some variability from battery to battery, and from use to use of the same battery. An optional system may be included that monitors and adjusts as needed, the battery voltage, to maintain a tighter tolerance of voltage than the battery normally supplies. One benefit of such a system is improved consistency in applicator performance and improved predictability in battery lifetime. Each time the heating circuit is activated (or "turned on"), it is preferable if the one or more batteries (7) is able to provide sufficient energy to raise the temperature of a product, as described herein. Many types of battery may be used, as long as the battery can deliver the requisite power to achieve defined performance levels. Examples of battery types include: zinc-carbon (or standard carbon), alkaline, lithium, nickel-cadmium (rechargeable), nickel-metal hydride (rechargeable), lithium-ion, zinc-air, zinc-mercury oxide and silver-zinc chemistries. Common household batteries, such as those used in flashlights and smoke detectors, are frequently found in small handheld devices. These typically include what are known as AA, AAA, C, D and 9 volt batteries. Other batteries that may be appropriate are those commonly found in hearing aides and wrist watches. Furthermore, it is preferable if the battery is disposable in the ordinary household waste stream. Therefore, batteries which, by law, must be separated from the normal household waste stream for disposal (such as batteries containing mercury) are less preferred. Optionally, the batteries may be rechargeable. For recharging, batteries may be removed from the battery compartment (1*g*) and recharged in a battery recharging device. Alternatively, the handle subassembly (1) may be designed to repose in a charging base, while the appropriate circuit elements (i.e. external contacts, internal circuitry) are provided as part of the handle subassembly. Alternatively, the applicator system may be powered from electrical mains with the appropriate circuit elements (i.e. cord with plug, internal circuitry) are provided as part of the handle subassembly, with or without a battery.

Products for Use with a Heated Applicator System According to the Invention

We have described the principles of the present invention with regard to mascara products and applicators, but the invention is applicable to any product that is applied with an extended applicator. Preferably, the product (P) and working surface (13*b*) of the applicator head (13) are matched for their intended purpose. For example, if the product is a mascara, then the applicator head is preferably of a type known to be used for mascara application, like a brush and/or comb having spaced apart bristles. One type of preferred material for a molded mascara brush is Hytrel® from DuPont de Nemours, having a preferred hardness of 47-55 Shore D. Or, for example, if the product is a face cream, then a working surface of the applicator head may comprise an extended, smooth surface, contoured for delivering product to portions of the face.

A non-exhaustive list of product types that may benefit from the present invention includes: products heated for aesthetic reasons (i.e. shave cream); those heated to activate an ingredient; those heated to alter the rheology of the product; those heated to sterilize the product; those heated to release an encapsulated ingredient, as by melting a gelatin capsule, for example. Particularly preferred products are eyelash products, such as mascara. Forms of product include mixtures, suspensions, emulsions, dispersions, colloids, creams, lotions, serums, gels, liquids, pastes, powders or any product that may be applied with a handheld applicator of the types known to be used in the cosmetic and personal care fields. Particularly preferred products are those that could be exploited by having some structural or dynamic property temporarily altered by heating. For example, heating may temporarily reduce the viscosity of a mascara product to improve application and make application easier, whereas, after cooling, the viscosity of the mascara may return to near pre-heating levels.

In general, as a material is heated, the change in temperature varies inversely with the heat capacity of the material. Therefore, considering the time and energy required to heat product contained in the reservoir (1), products having a smaller heat capacity may be thought of as more efficient than products having a larger heat capacity. Among cosmetic liquids, water has one of the higher heat capacities. Therefore, in general a personal care composition with less water may heat more efficiently than one with more water, all else being the same. For some applications then, it may be preferable to use a product that has less than 50% water, more preferably less than 25% water, and more preferably still less than 10% water and most preferably, an anhydrous product. Of course, not every type of product can be implemented as an anhydrous or low water product, and personal care compositions having 50% or more of water may still be suitable for use in a system according to the present invention.

Offered as a Set

Figure 29:
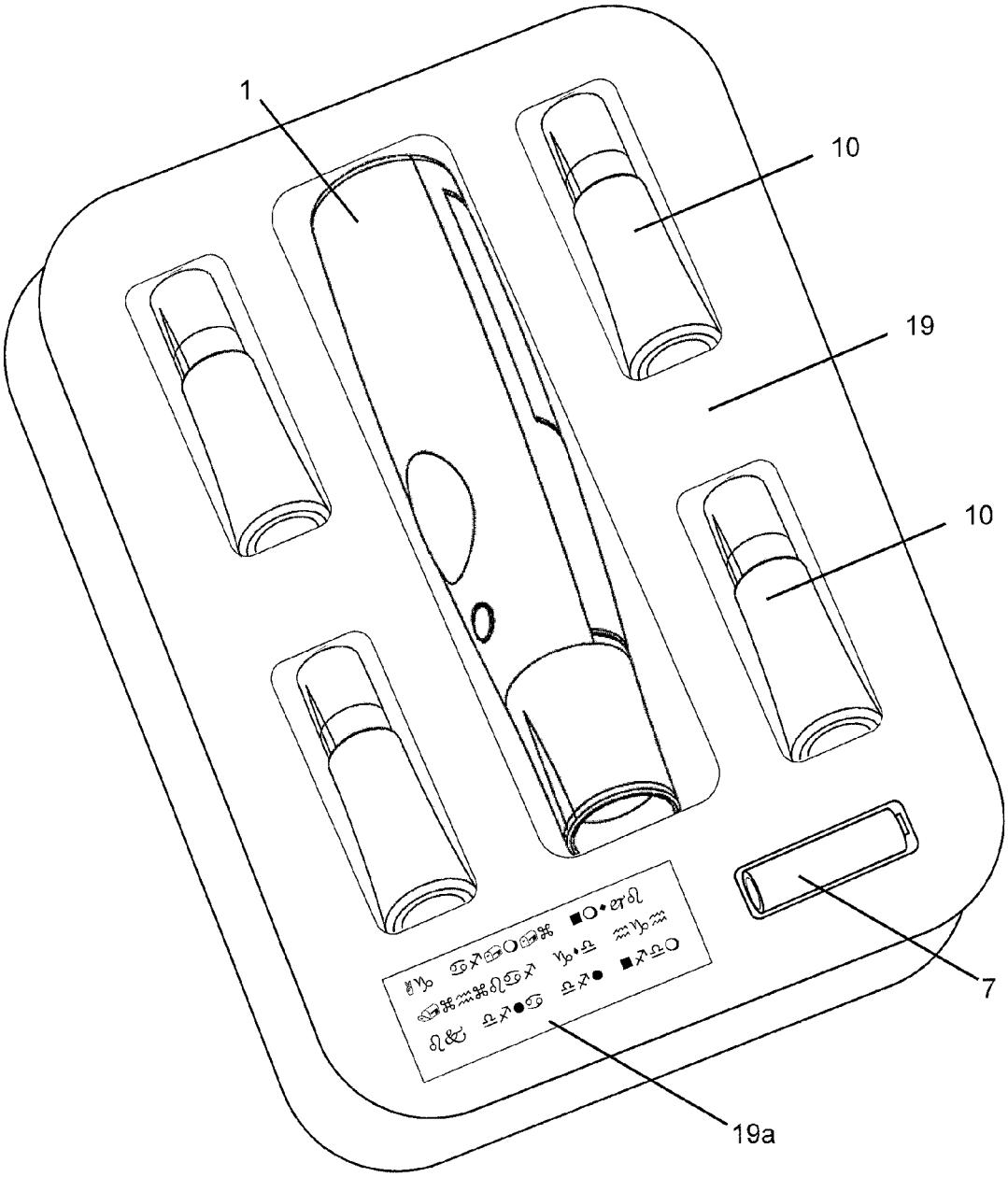
FIG. 29 depicts a makeup/personal care set comprising an outer package (19) that houses a reusable handle subassembly (1) and more than one disposable container subassembly (10).

Referring to FIG. 29, a heating applicator system with reusable components, as described herein, is well suited to be offered as a makeup/personal care set, housed in an outer package (19) that comprises at least one reusable handle subassembly (1) and more than one container subassembly (10). Optionally, when there is more than one container subassembly in the set, all the reservoirs need not contain the same product. For example, an outer package may hold one reusable handle subassembly (1), and two, three, four or more container subassemblies, the reservoirs containing mascara products of at least two different colors. Optionally, the outer package may also comprise instructions (19*a*) for use of the applicator system, and/or for directing a user to instructions for use. For example, instructions for use may be printed on a substrate that is included in the outer packaging. Alternatively, the outer packaging may direct the user to a website where instructions for use can be viewed on a monitor. Instructions for use may include some or all of the following: how to assemble the handle subassembly (1) to the container subassembly (10); how to turn on the heating elements (16*b*), how long to wait for product to heat before applying, how to turn off the heating elements, how to access and change the battery (7), how to detach a container subassembly from the handle subassembly, how to dispose of any part of the system. Optionally, the outer packaging may include one or more batteries intended to power the heating generating portion of the container subassembly.

Method of Use

A typical method of using the present invention comprises the steps of connecting one of the disposable container subassemblies (10) to the reusable handle subassembly (1); heating the product (P) in the reservoir (11*a*); transferring product (P) from the reservoir (11*a*) to a target surface; separating the handle subassembly (1) and the container subassembly (10); discarding the separated container subassembly (10); and connecting a new disposable container subassembly (10) to the reusable handle subassembly (1). The steps of connecting comprise inserting the hollow collar (14) of one of the disposable container subassemblies (10) into the hollow handle (1*d*) of the reusable handle subassembly (1) so that a rigid, detachable connection between the collar and handle is established, and an electrical connection between the three metal contacts (18*b*, 18*c*, 18*d*) of the lower printed circuit board (16), and the three metallic leads (8*b*, 8*c*, 8*d*) of the upper printed circuit board (6), is established. The step of heating product in the reservoir comprises activating the on-off control (1*h*) on the handle (1*d*), and waiting a specified time. The step of transferring product (P) comprises unscrewing the collar (14) from the container (11), lifting the applicator head (13) out of the reservoir (11*a*), transferring product from the applicator head to a target surface, and returning the applicator head (13) to the reservoir (11*a*). The step of separating comprises screwing the collar (14) onto the container (11), pulling apart the handle subassembly (1) and the container subassembly (10), longitudinally.

CONCLUSION

We have described a applicator system for heating personal care products wherein the applicator system has reusable components. With our new heating applicator system, the most expensive components may be reused, again and again, while each empty container is replaced by a fresh one. The present invention addresses the need for an applicator system that heats personal care products without concerns for dry-out as a result of repeated exposure to heat, and without an unsightly elongated member projecting from the handle subassembly, so the possibility of breakage is eliminated, and the appearance of the component is improved. The present invention is not limited to the embodiments described herein, and is only limited by the appended claims.

What is claimed is:

1. A heating applicator system comprising:

a disposable container subassembly (10) that comprises:

a container (11) that has a neck (11*c*) and a reservoir (11*a*);

a hollow collar (14) that has a distal end (14*d*) that is attached to the neck (11*c*) of the container (11) in a detachable and reattachable manner; and a proximal end (14*c*) that retains a metal insert (15);

a hollow applicator head (13) that depends from the hollow collar (14) into the reservoir (11*a*), the applicator head comprising:

a proximal end (13*c*) that is retained in the collar (14); and a distal end (13*d*) that supports a working surface (13*b*), such that when the container (11), hollow collar (14) and hollow applicator head (13) are assembled, the reservoir (11*a*) is sealed off from the ambient environment, and the working surface (13*b*) of the applicator head (13) is immersed in the reservoir;

a lower printed circuit board (16) that has:

a distal end (16*d*) that is disposed in the applicator head (13), and that supports a heat generation portion (16*j*) immediately under the working surface (13*b*); and a proximal end (16*c*) that supports three metallic contacts (18*b*, 18*c*, 18*d*) that have electrical contact with the heat generating portion (16*j*), and that extend above the proximal end (13*c*) of the hollow applicator head (13), but do not protrude above the proximal end (14*c*) of the collar (14);

wherein the disposable container subassembly (10) does not comprise a complete heating circuit;

a reusable handle subassembly (1) that comprises:

a hollow handle (1*d*) that has a distal end (1*f*) that is able to form a rigid, detachable connection to the collar (14);

a magnet (4) located near a distal end (1*f*) of the handle (1*d*);

an on-off control (1*h*) located on the surface of the handle (1*d*) that is effective to alternately open and close a completed heating circuit;

an upper printed circuit board (6) that has a distal end (6*f*) that supports three metallic leads (8*b*, 8*c*, 8*d*) that have electrical contact with the battery (7) and that do not protrude beyond the distal end (1*f*) of the handle (1*d*);

a battery (7) located in the handle (1*d*), whose positive (7*d*) and negative (7*b*) terminals are in electrical contact with the upper printed circuit board (6); and wherein the reusable handle subassembly (1) does not comprise a complete heating circuit;

wherein, the hollow collar (14) is inserted into the handle (1*d*) to establish a rigid, detachable connection between the collar and handle, and an electrical connection between the three metal contacts (18*b*, 18*c*, 18*d*) of the lower printed circuit board (16) and the three metallic leads (8*b*, 8*c*, 8*d*) of the upper printed circuit board (6), to complete a heating circuit.

2. The heating applicator system of claim 1 further comprising an LED indicator light (6*i*) that shines through a hole (1*j*) in the first body section (1*a*) when the heating circuit is closed.

3. The heating applicator system of claim 1 further comprising a thermistor located near the distal end of the lower PCB (16).

4. The heating applicator system of claim 1 wherein the neck (11*c*) and the hollow collar (14) have cooperating screw threads.

5. The heating applicator system of claim 1 further comprising a wiper (12) that sits in the neck of the container (11), while a flange (12*e*) of the wiper rests on the top of the neck.

6. The heating applicator system of claim 1 wherein slots (13*f*, 13*g*) for receiving the proximal end (16*c*) of the lower printed circuit board (16) are provided on an interior surface of the hollow applicator head (13) for ensuring that the lower printed circuit board adopts a specific orientation with respect to the hollow applicator head.

7. The heating applicator system of claim 6 wherein arcuate spaces (14*h*, 14*i*) are provided on the interior of the hollow collar (14) for receiving arcuate protrusions (13*h*, 13*i*) located on the proximal end of the of the applicator head (13), for ensuring that the hollow applicator head adopts a specific orientation with respect to the collar.

8. The heating applicator system of claim 1 further comprising a viscous heat transfer material located in the distal end (13*d*) of the hollow applicator head (13), such that the heat generating portion (16*j*) is immersed in the viscous heat transfer material.

9. The heating applicator system of claim 1 wherein the upper printed circuit board (6) comprises one or more of the following: resistors, capacitors, thermistors, amplifiers, MOSFET switches, voltage dividers, voltage comparators, power inverters, noise reducing components, light emitting diodes, integrated circuits and central processing units.

10. The heating applicator system of claim 1 wherein the heat generating portion (16*j*) comprises a bank of discrete, fixed value resistive heating elements (16*b*), electronically arranged in series, parallel, or any combination thereof, and physically situated in two rows, one on either side of the lower PCB (16).

11. The heating applicator system of claim 10 wherein the number of resistive heating elements (16*b*) is 10 to 60, each having a rated resistance from 1 to 100 ohms, and the equivalent resistance of all the heating elements is from 1 to 10 ohms.

12. The heating applicator system of claim 11 having thirty-five resistive heating elements arranged in parallel, each having a resistance of 75 ohms.

13. The heating applicator system of claim 1 wherein the ring magnet (4) and metal insert (15) produce a retaining force of about 4-9 newton.

14. A makeup set comprising:

more than one disposable container subassembly (10), wherein each disposable container subassembly comprises:

a container (11) that has a neck (11*c*) and a reservoir (11*a*);

a product (P) disposed in the reservoir (11*a*);

a hollow collar (14) that has a distal end (14*d*) that is attached to the neck (11*c*) of the container (11) in a detachable and reattachable manner; and a proximal end (14*c*) that retains a metal insert (15);

a hollow applicator head (13) that depends from the hollow collar (14) into the reservoir (11*a*), the applicator head comprising:

a proximal end (13*c*) that is retained in the collar (14); and a distal end (13*d*) that supports a working surface (13*b*), such that when the container (11), hollow collar (14) and hollow applicator head (13) are assembled, the reservoir (11*a*) is sealed off from the ambient environment, and the working surface (13*b*) of the applicator head (13) is immersed in the reservoir;

a lower printed circuit board (16) that has:

a distal end (16*d*) that is disposed in the applicator head (13), and that supports a heat generation portion (16*j*) immediately under the working surface (13*b*); and a proximal end (16*c*) that supports three metallic contacts (18*b*, 18*c*, 18*d*) that have electrical contact with the heat generating portion (16*j*), and that extend above the proximal end (13*c*) of the hollow applicator head (13), but do not protrude above the proximal end (14*c*) of the collar (14);

wherein each disposable container subassembly (10) does not comprise a complete heating circuit;

a reusable handle subassembly (1) that comprises:

a hollow handle (1*d*) that has a distal end (1*f*) that is able to form a rigid, detachable connection to the collar (14);

a magnet (4) located near a distal end (1*f*) of the handle (1*d*);

an on-off control (1*h*) located on the surface of the handle (1*d*) that is effective to alternately open and close a completed heating circuit;

an upper printed circuit board (6) that has a distal end (6*f*) that supports three metallic leads (8*b*, 8*c*, 8*d*) that have electrical contact with the battery (7) and that do not protrude beyond the distal end (1*f*) of the handle (1*d*);

a battery (7) located in the handle (1*d*), whose positive (7*d*) and negative (7*b*) terminals are in electrical contact with the upper printed circuit board (6); and wherein the reusable handle subassembly (1) does not comprise a complete heating circuit;

wherein, when the hollow collar (14) of any one of the disposable container subassemblies (10) is inserted into the hollow handle (1*d*) of the reusable handle subassembly (1), a rigid, detachable connection between the collar and handle is established, and an electrical connection between the three metal contacts (18*b*, 18*c*, 18*d*) of the lower printed circuit board (16), and the three metallic leads (8*b*, 8*c*, 8*d*) of the upper printed circuit board (6), is established, to complete a heating circuit.

15. A method of using a makeup set according to claim 14 comprising the steps of:

connecting one of the disposable container subassemblies (10) to the reusable handle subassembly (1);

heating the product (P) in the reservoir (11*a*);

transferring product (P) from the reservoir (11*a*) to a target surface;

separating the handle subassembly (1) and the container subassembly (10);

discarding the separated container subassembly (10);

connecting a new disposable container subassembly (10) to the reusable handle subassembly (1), wherein the steps of connecting comprise inserting the hollow collar (14) of one of the disposable container subassemblies (10) into the hollow handle (1*d*) of the reusable handle subassembly (1) so that a rigid, detachable connection between the collar and handle is established, and an electrical connection between the three metal contacts (18*b*, 18*c*, 18*d*) of the lower printed circuit board (16), and the three metallic leads (8*b*, 8*c*, 8*d*) of the upper printed circuit board (6), is established;

the step of heating product (P) in the reservoir (11*a*) comprises activating the on-off control (1*h*) on the handle (1*d*), and waiting a specified time;

the step of transferring product (P) comprises unscrewing the collar (14) from the container (11), lifting the applicator head (13) out of the reservoir (11*a*), transferring product from the applicator head to a target surface, returning the applicator head (13) to the reservoir (11*a*); and the step of separating comprises screwing the collar (14) onto the container (11), pulling apart the handle subassembly (1) and the container subassembly (10), longitudinally.

* * * * *